US012796787B2

(12) United States Patent
Annaka et al.

(10) Patent No.: US 12,796,787 B2
(45) Date of Patent: Nov. 17, 2026

(54) SLIDE FASTENER

(71) Applicant: YKK Corporation, Tokyo (JP)

(72) Inventors: Shigeki Annaka, Cheshire (GB); Matthew Rawstron, Cheshire (GB)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 19/120,541

(22) PCT Filed: Sep. 7, 2023

(86) PCT No.: PCT/GB2023/052313

§ 371 (c)(1),
(2) Date: Apr. 11, 2025

(87) PCT Pub. No.: WO2024/079434

PCT Pub. Date: Apr. 18, 2024

(65) Prior Publication Data

US 2026/0130473 A1 May 14, 2026

(30) Foreign Application Priority Data

Oct. 14, 2022 (GB) ..... 2215234

(51) Int. Cl.
*A44B 19/02* (2006.01)
*A44B 19/06* (2006.01)
*A44B 19/30* (2006.01)

(52) U.S. Cl.
CPC ..... *A44B 19/305* (2013.01); *A44B 19/06* (2013.01)

(58) Field of Classification Search
CPC ..... A44B 19/305; A44B 19/06; A44B 19/02; A44B 19/04; A44B 19/08; A44B 19/403
See application file for complete search history.

(56) References Cited

U.S. PATENT DOCUMENTS 1,720,080 A * 7/1929 Kennedy ..... A44B 19/04 24/411
2,495,033 A * 1/1950 Sullivan ..... A44B 19/04 24/410

(Continued)

FOREIGN PATENT DOCUMENTS

CH 260067 A 2/1949
CH 281732 A 3/1952

(Continued)

OTHER PUBLICATIONS

International Search Report, PCT Patent Application No. PCT/GB2023/052313, Dec. 4, 2023, 6 pages.

(Continued)

*Primary Examiner* — Jack W Lavinder
(74) *Attorney, Agent, or Firm* — Kilpatrick Townsend & Stockton LLP

(57) ABSTRACT

In a coupling element for a slide fastener, a first groove portion of an upper groove defines a minimum depth, the minimum depth of the first groove portion of the upper groove being less than a depth of the entirety of a second groove portion of the upper groove; and a second groove portion of a lower groove defines a minimum depth, the minimum depth of the second groove portion of the lower groove being less than a depth of the entirety of a first groove portion of the lower groove.

16 Claims, 20 Drawing Sheets

(56) References Cited

U.S. PATENT DOCUMENTS

| | | | | |
|---|---|---|---|---|
| 2,798,275 | A * | 7/1957 | Morin | A44B 19/04 24/410 |
| 2011/0000053 | A1* | 1/2011 | Dono | A44B 19/12 24/399 |
| 2013/0133161 | A1* | 5/2013 | Ren | A44B 19/303 24/434 |
| 2020/0345110 | A1 | 11/2020 | Tung et al. | |
| 2023/0013090 | A1 | 1/2023 | Tung et al. | |

FOREIGN PATENT DOCUMENTS

| | | | |
|---|---|---|---|
| CN | 201911427 | U | 8/2011 |
| CN | 204169187 | U | 2/2015 |
| CN | 111150179 | A | 5/2020 |
| CN | 213045671 | U | 4/2021 |
| EP | 3656243 | A1 | 5/2020 |
| JP | 2016-202761 | A | 12/2016 |
| TW | 202102157 | A | 1/2021 |
| WO | 2022-043684 | A1 | 3/2022 |
| WO | 2023-188402 | A1 | 10/2023 |

OTHER PUBLICATIONS

Written Opinion, PCT Patent Application No. PCT/GB2023/052313, Dec. 4, 2023, 9 pages.
Office Action, Taiwanese Patent Application No. 112139153, May 31, 2024, 13 pages.

* cited by examiner

RELATED ART

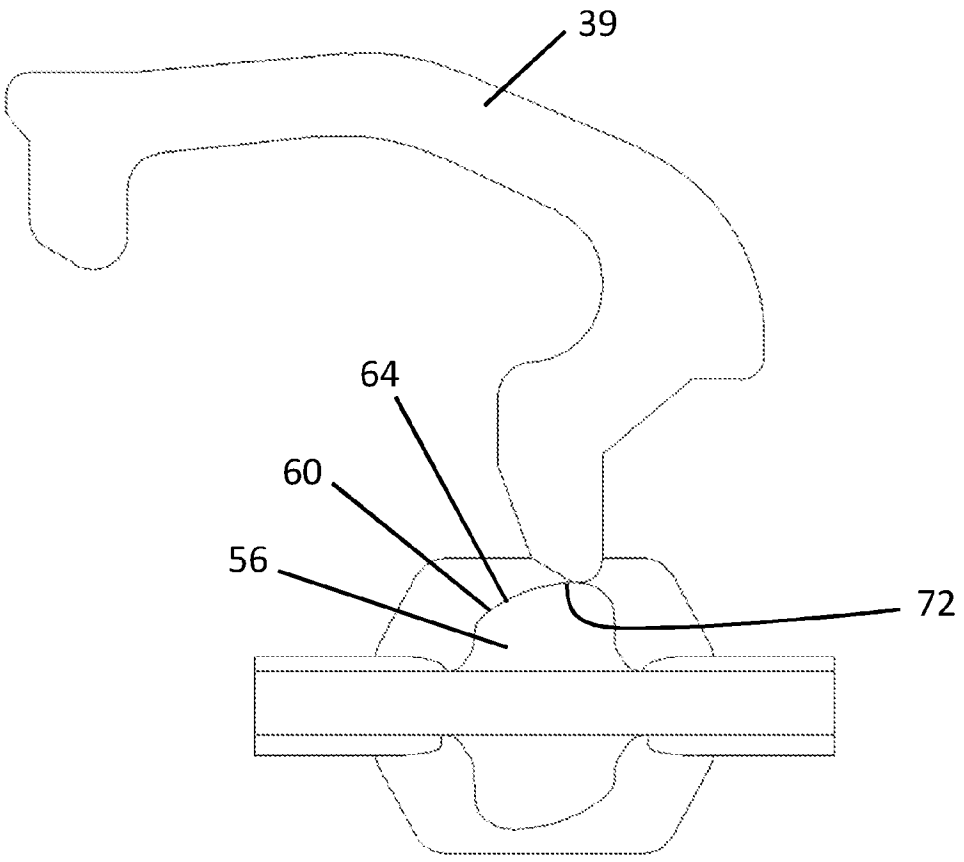
Figure 10
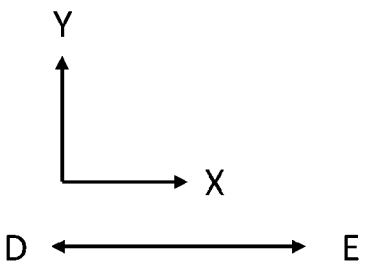

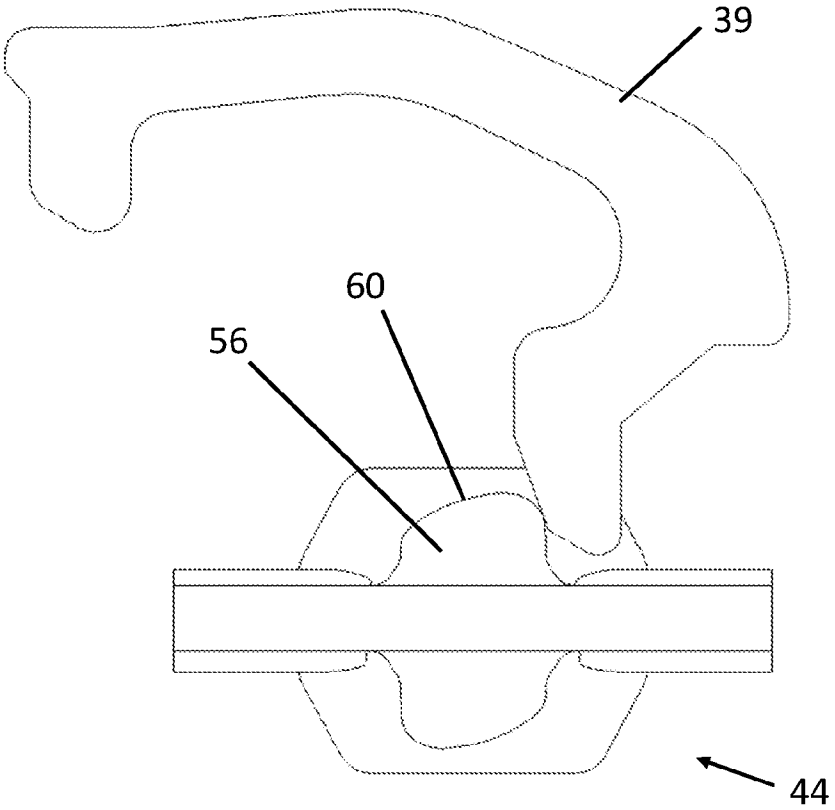
Figure 11
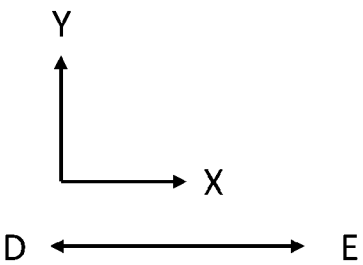

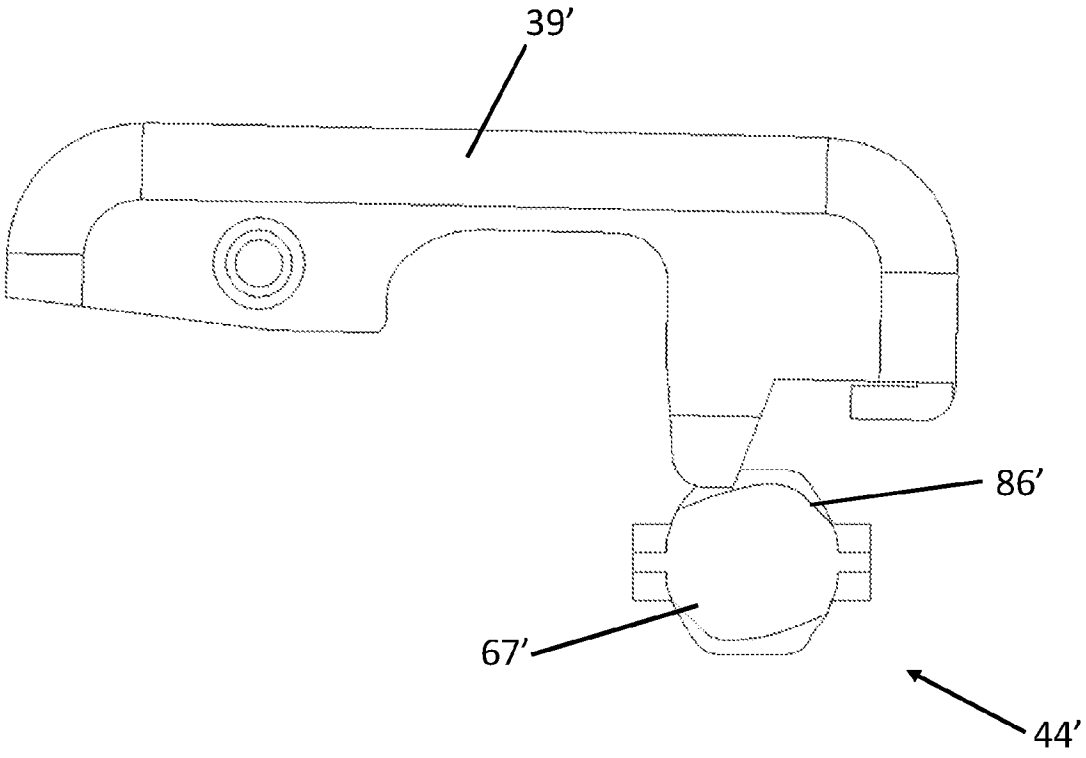
Figure 16
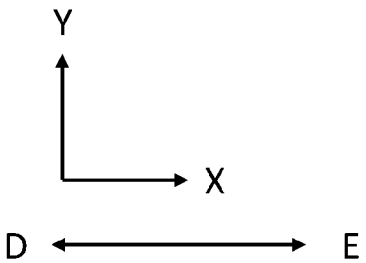

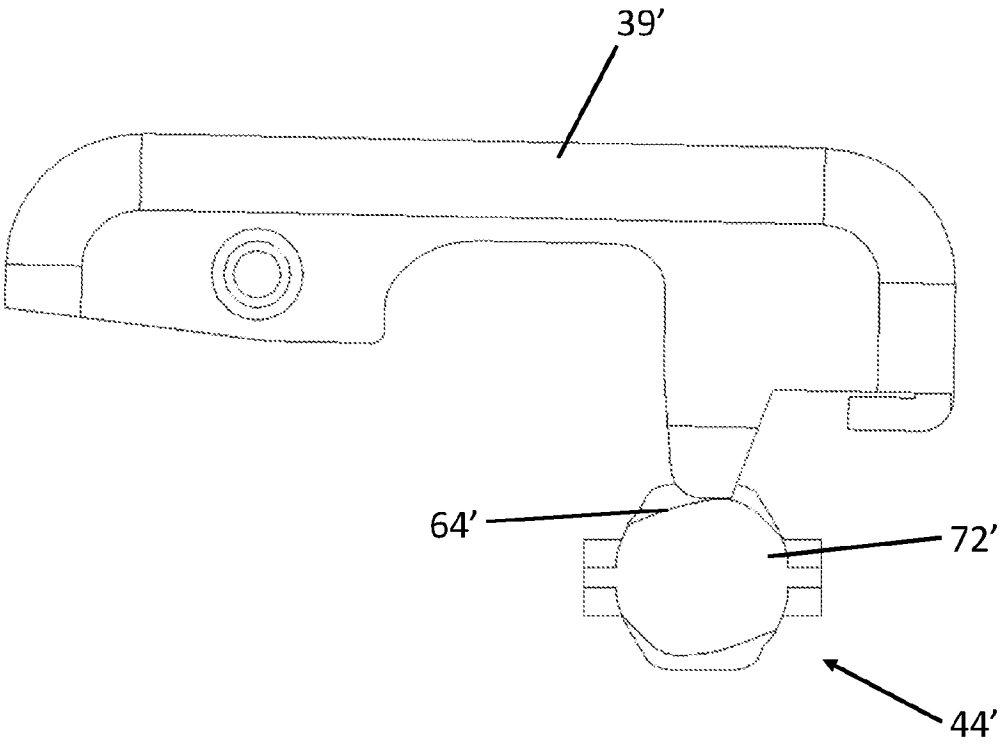
Figure 17
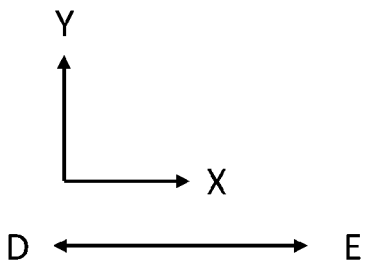

SLIDE FASTENER

FIELD OF INVENTION

The present invention relates to a coupling element for a slide fastener.

BACKGROUND

Slide fasteners (or zips or zippers) typically comprise a pair of stringers and a slider. Each stringer comprises a tape, and a plurality of coupling elements that extend along a first edge of each tape. When moved in a first direction, the slider couples, or interdigitates, corresponding coupling elements of each tape. When moved in a second direction, opposite to the first direction, the slider decouples the coupling elements from one another.

Sliders may comprise a locking pin. The locking pin is movable between a first position and a second position. In the first position, the locking pin engages one or more coupling elements of the slide fastener, such that the position of the slider along the stringers is generally fixed. In the second position, the locking pin is disengaged from the coupling elements, such that the slider can be moved along the stringers by a user. In the first position, the locking pin may damage the coupling elements if a load to move the slider in the second direction exceeds a predetermined value.

It is an object of the present invention to mitigate or obviate one or more problems associated with known slide fasteners, whether identified herein or otherwise.

SUMMARY

In a first aspect of the invention there is provided a coupling element for a slide fastener. The coupling element comprises a main body having spaced shoulder portions, an upper surface and a lower surface. The main body being configured to be mountable, in use, to a fastener tape of the slide fastener. The coupling element further comprises a head portion extending parallel to a lateral axis, away from the shoulder portions via a neck located between the shoulder portions. The neck comprises an upper surface and a lower surface. The coupling element defines a proximal portion. The proximal portion comprises the main body and the neck. The proximal portion comprises an upper surface and a lower surface. The proximal portion defines a first portion and a second portion. The second portion is disposed along a longitudinal axis, perpendicular to the lateral axis, adjacent to the first portion. The proximal portion comprises an upper groove that extends parallel to the longitudinal axis along the upper surface of the proximal portion. The upper groove has a first groove portion in the region of the first portion of the proximal portion and a second groove portion in the region of the second portion of the proximal portion. The first groove portion of the upper groove defines a minimum depth. The minimum depth of the first groove portion of the upper groove is less than a depth of the entirety of the second groove portion of the upper groove. The proximal portion comprises a lower groove that extends parallel to the longitudinal axis along the lower surface of the proximal portion. The lower groove having a first groove portion in the region of the first portion of the proximal portion and a second groove portion in the region of the second portion of the proximal portion. The second groove portion of the lower groove defines a minimum depth. The minimum depth of the second groove portion of the lower groove is less than a depth of the entirety of the first groove portion of the lower groove.

The proximal portion is called so due to it being proximal to the fastener tape when mounted thereon.

The depth of the first groove may be understood to refer to a distance, measured in a direction parallel to an axis perpendicular to the longitudinal axis and to the lateral axis, from the upper surface of the body of the coupling element to the upper surface of the proximal portion.

The depth of the second groove may be understood to refer to a distance, measured in a direction parallel to a normal axis perpendicular to the longitudinal axis and to the lateral axis, from the lower surface of the body of the coupling element to the lower surface of the proximal portion.

The minimum depth of the first groove portion of the upper groove may be a minimum depth of the upper groove. The minimum depth of the second groove portion of the lower groove may be a minimum depth of the lower groove.

In use, the coupling element is mounted on to a fastener tape of a stringer of a slide fastener. Slide fasteners include sliders that can be provided with locking pins. Where a locking pin is provided, it is movable between a first position in which it engages one or more coupling elements of the slide fastener, and a second position in which it is disengaged from the coupling elements of the slide fastener. Since the minimum depth of the first groove portion of the upper groove is less than the depth of the entirety of the second groove portion of the upper groove, the thickness of the proximal portion in the region of the second groove portion is less than the proximal portion in the region of the first groove portion. The proximal portion being thinner in the region of the second groove portion than in the region of the first groove portion advantageously allows the force that is required for an engaged locking pin to ride over the proximal portion to be optimised. Optimising the force that is required for an engaged locking pin to ride over the proximal portion is desirable because the force required that is required for an engaged locking pin to ride over the proximal portion can exceed the force that is required to remove the coupling element from the fastener tape. Therefore, optimising the force that is required for an engaged locking pin to ride over the proximal portion advantageously reduces the likelihood of the coupling element being removed from the fastener tape by a locking pin in use.

Stringers can be mounted onto a garment or other item in one of two orientations—in a first orientation or a second orientation, the second orientation being rotated 180 degrees about a longitudinal axis with respect to the first orientation. Since the minimum depth of the second groove portion of the lower groove is less than the depth of the entirety of the first groove portion of the lower groove, and the minimum depth of the first groove portion of the upper groove is less than the depth of the entirety of the second groove portion of the upper groove, the coupling element provides the above advantages regardless of whether the stringer is mounted onto the garment or other item in the first orientation or in the second orientation.

In addition, since the minimum depth of the first groove portion of the upper groove is less than the depth of the entirety of the second groove portion of the upper groove, and the minimum depth of the second groove portion of the lower groove is less than the depth of the entirety of the first groove portion of the lower groove, the proximal portion is strengthened in a direction parallel to the lateral axis, while still allowing the force required for an engaged locking pin to ride over the proximal portion to be optimised. This is as compared to if the upper groove, lower groove, or both were of constant depth.

The second groove portion of the upper groove may define a maximum depth. The maximum depth of the second groove portion of the upper groove may be greater than a depth of the entirety of the first groove portion of the upper groove.

The maximum depth of the second groove portion of the upper groove may be a maximum depth of the upper groove.

Where the maximum depth of the second groove portion of the upper groove is greater than the depth of the entirety of the first groove portion of the upper groove, the force that is required for a locking pin to ride over the groove of the proximal portion is further optimised.

The maximum depth of the second groove portion of the upper groove may be at least 15% greater than the minimum depth of the first groove portion of the upper groove. The maximum depth of the second groove portion of the upper groove may be up to seven times greater than the minimum depth of the first groove portion of the upper groove.

Where the maximum depth of the second groove portion of the upper groove is at least 15% greater than, and/or up to seven times greater than, the minimum depth of the first groove portion of the upper groove, the force that is required for a locking pin to ride over the groove is further optimised.

The first groove portion of the lower groove may define a maximum depth. The maximum depth of the first groove portion of the lower groove may be greater than a depth of the entirety of the second groove portion of the lower groove.

The maximum depth of the first groove portion of the lower groove may be a maximum depth of the lower groove.

Where the maximum depth of the first groove portion of the lower groove is greater than the depth of the entirety of the second groove portion of the lower groove, the force that is required for a locking pin to ride over the groove is further optimised in both possible orientations of the coupling element.

The maximum depth of the first groove portion of the lower groove may be at least 15% greater than the minimum depth of the second groove portion of the lower groove. The maximum depth of the first groove portion of the lower groove may be up to seven times greater than the minimum depth of the second groove portion of the lower groove.

Where the maximum depth of the first groove portion of the lower groove is at least 15% greater than, and/or up to seven times greater than, the minimum depth of the second groove portion of the lower groove, the force that is required for a locking pin to ride over the groove is further optimised in both possible orientations of the coupling element.

The proximal portion may be rotationally symmetric when viewed in a cross-sectional plane that is perpendicular to the lateral axis and including the upper groove and the lower groove.

The rotational symmetry of the proximal portion when viewed in a cross-sectional plane that is perpendicular to the lateral axis may have an order of two.

The proximal portion being rotationally symmetric may be understood to refer to the proximal portion being rotationally symmetric in at least one cross-sectional plane that is perpendicular to the lateral axis. In some embodiments, at least 25% of the length of the proximal portion may be rotationally symmetric in a cross-sectional plane that is perpendicular to the lateral axis. The length of the proximal portion may extend in a direction parallel to the lateral axis.

The coupling element may be formed via injection moulding, or any other suitable process. Typically, forming the coupling element will involve heating a material, and shaping that material to form the coupling element. Where the proximal portion is rotationally symmetric when viewed in a cross-sectional plane that is perpendicular to the lateral axis, cooling of the proximal portion is advantageously more uniform as compared to where the proximal portion is not rotationally symmetric.

The main body may define a thickness that extends from the upper surface to the lower surface in a direction perpendicular to the lateral axis and to the longitudinal axis. The maximum depth of the second groove portion of the upper groove may be at least 5% of the thickness of the main body. The maximum depth of the second groove portion of the upper groove may be up to 30% of the thickness of the main body. The maximum depth of the first groove portion of the lower groove may be at least 5% of the thickness of the main body. The maximum depth of the first groove portion of the lower groove may be up to 30% of the thickness of the main body.

The maximum depth of the groove portions refers to the greatest depth of the respective groove portion. The minimum depth of the groove portions refers to the smallest depth of the respective groove portion.

Where the maximum depth of the second groove portion of the upper groove is at least 5% and/or up to 30% of the thickness of the main body, the strength of the proximal portion in a direction parallel to the lateral axis, and parallel to the longitudinal axis is improved.

Where the maximum depth of the first groove portion of the lower groove is at least 5% and/or up to 30% of the thickness of the main body, the strength of the proximal portion in a direction parallel to the lateral axis, and in a direction parallel to the longitudinal axis, is improved.

The first portion of the proximal portion may comprise 50% of the length of the proximal portion in a direction parallel to the longitudinal axis. The second portion of the proximal portion may comprise 50% of the length of the proximal portion in a direction parallel to the longitudinal axis.

The first portion of the proximal portion may define a first end in a direction parallel to the longitudinal axis. The second portion of the proximal portion may define a second end in a direction parallel to the longitudinal axis. The minimum depth of the first portion of the upper groove may be offset from the first end of the proximal portion in a direction parallel to the longitudinal axis. The minimum depth of the second portion of the lower groove may be offset from the second end of the proximal portion in a direction parallel to the longitudinal axis.

The upper groove and the lower groove may be formed in the neck. The upper groove and the lower groove may be formed in the main body.

The one of the main body and the neck that comprises the upper groove and the lower groove may be generally parallelogram-shaped in a cross-section taken perpendicular to the lateral axis and in a plane including the upper groove and the lower groove.

In a second aspect of the invention there is provided a stringer for a slide fastener. The stringer comprises a fastener tape that defines a longitudinal edge, and a plurality of coupling elements according to the first aspect of the invention. The plurality of coupling elements are mounted along the longitudinal edge of the fastener tape.

In a third aspect of the invention there is provided a slide fastener comprising a first stringer according to the second aspect of the invention and a second stringer according to the second aspect of the invention. The coupling elements of the first stringer are couplable to the coupling elements of the second stringer along a fastener axis. The slide fastener further comprises a first slider that comprises a locking pin. The locking pin is movable between a first position in which the locking pin is engageable with one or more coupling elements of the first stringer and/or of the second stringer, and a second position in which the locking pin is disengaged from the coupling elements of the first stringer and of the second stringer. The first slider is movably mounted on the first stringer and the second stringer in use, such that the first slider is movable relative to the first stringer and the second stringer along a first direction, towards an upper end of the slide fastener, in order to interdigitate the coupling elements of the first stringer with the coupling elements of the second stringer. The first slider is also moveable along a second direction, away from the upper end of the slide fastener, in order to decouple the coupling elements of the first stringer from the coupling elements of the second stringer.

The locking pin being disengaged from the coupling elements may be understood to mean that the locking pin is spaced apart, preferably in a direction parallel to a normal axis that is perpendicular to the lateral and longitudinal axis, from the coupling elements of the first stringer and/or of the second stringer.

The slide fastener may comprise a second slider. The second slider may comprise a locking pin. The locking pin may be movable between a first position and a second position. In the first position, the locking pin may engage one or more coupling elements of the first stringer and/or of the second stringer. In the second position, the locking pin may be disengaged from the coupling elements of the first stringer and of the second stringer.

The second slider may be movably mounted on the first stringer and/or the second stringer in use, such that the second slider is movable relative to the first stringer and the second stringer. The second slider may be movable relative to the first stringer and the second stringer along a first direction, towards the upper end of the slide fastener, in order to decouple the coupling elements of the first stringer from the coupling elements of the second stringer. The second slider may be movable relative to the first stringer and the second stringer along a second direction, away from the upper end of the slide fastener, in order to interdigitate the coupling elements of the first stringer with the coupling elements of the second stringer.

In the first position, the locking pin of the first slider may engage one or more coupling elements of the first stringer. In the first position, the locking pin of the second slider may engage one or more coupling elements of the second stringer.

The plurality of coupling elements of the first stringer may be orientated such that the minimum depth of the first groove portion of the upper groove of each of the coupling elements face the upper end of the slide fastener.

The plurality of coupling elements of the second stringer may be orientated such that the minimum depth of the first groove portion of the upper groove of each of the coupling elements face away from the upper end of the slide fastener.

The coupling elements and locking pin may be configured such that, with the locking pin in the first position, the locking pin passes over the one or more coupling elements with which it is engaged once a load to move the first slider along the second direction exceeds a predetermined value.

The plurality of coupling elements of the second stringer may be orientated such that the minimum depth of the first groove portion of the upper groove of each of the coupling elements face away from the upper end of the slide fastener.

Features disclosed with respect to one aspect of the invention can be combined with other aspects of the invention.

BRIEF DESCRIPTION OF THE DRAWINGS

Embodiments of the present invention will now be discussed with reference to the accompanying drawings, in which:

FIGS. 8 to 11 show a side view of the coupling element of FIG. 5 in use;

FIGS. 15 to 18 show a side view of the coupling element of FIG. 12 in use;

DETAILED DESCRIPTION

Figure 1:
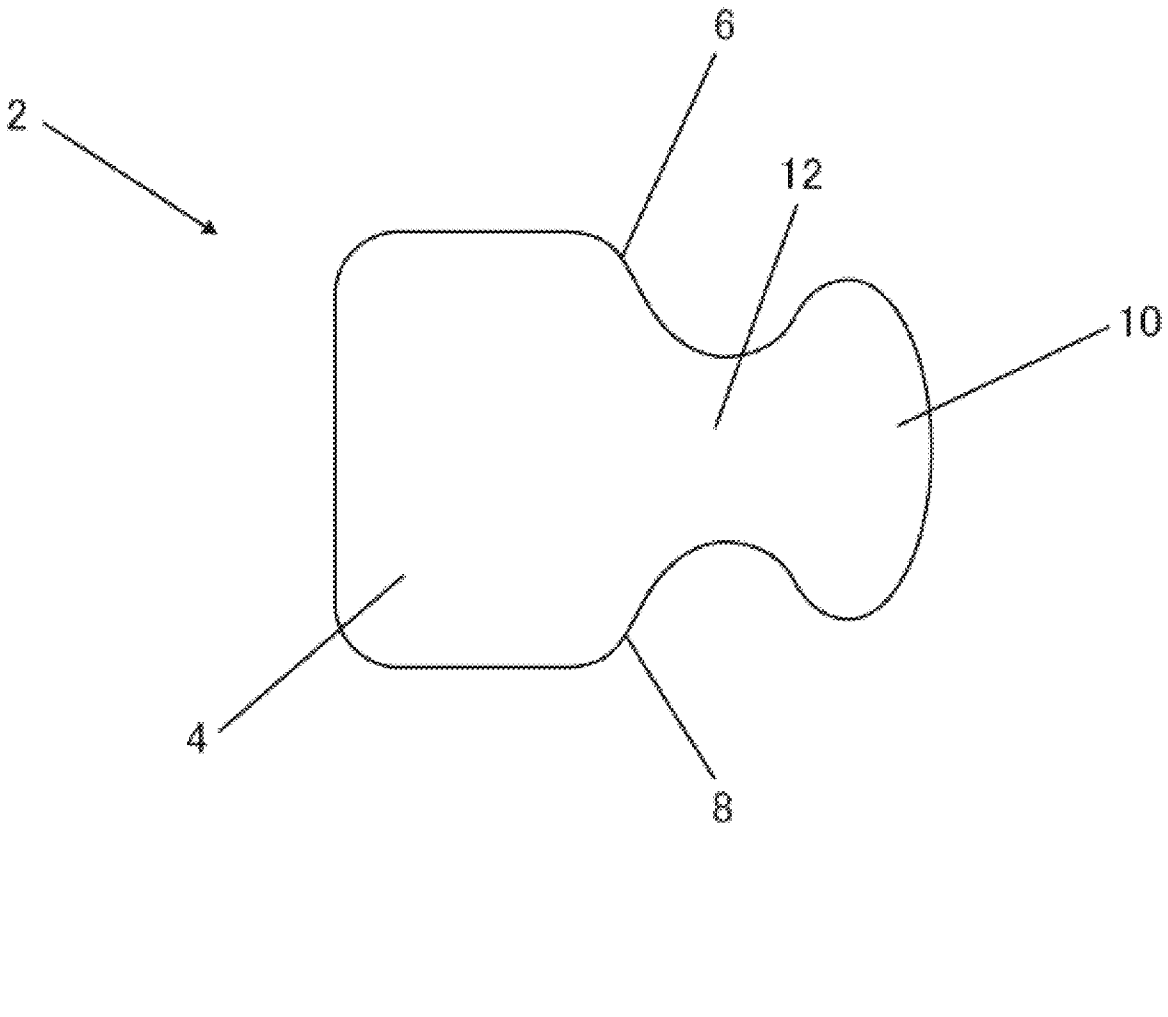
FIG. 1 shows a known coupling element.

FIG. 1 shows a known coupling element 2 for a slide fastener. The coupling element 2 comprises a main body 4. The main body comprises spaced shoulder portions 6, 8. The coupling element 2 further comprises a head portion 10. The head portion 10 extends parallel to a lateral axis Z, away from the shoulder portions 6, 8, via a neck 12.

Figure 2:
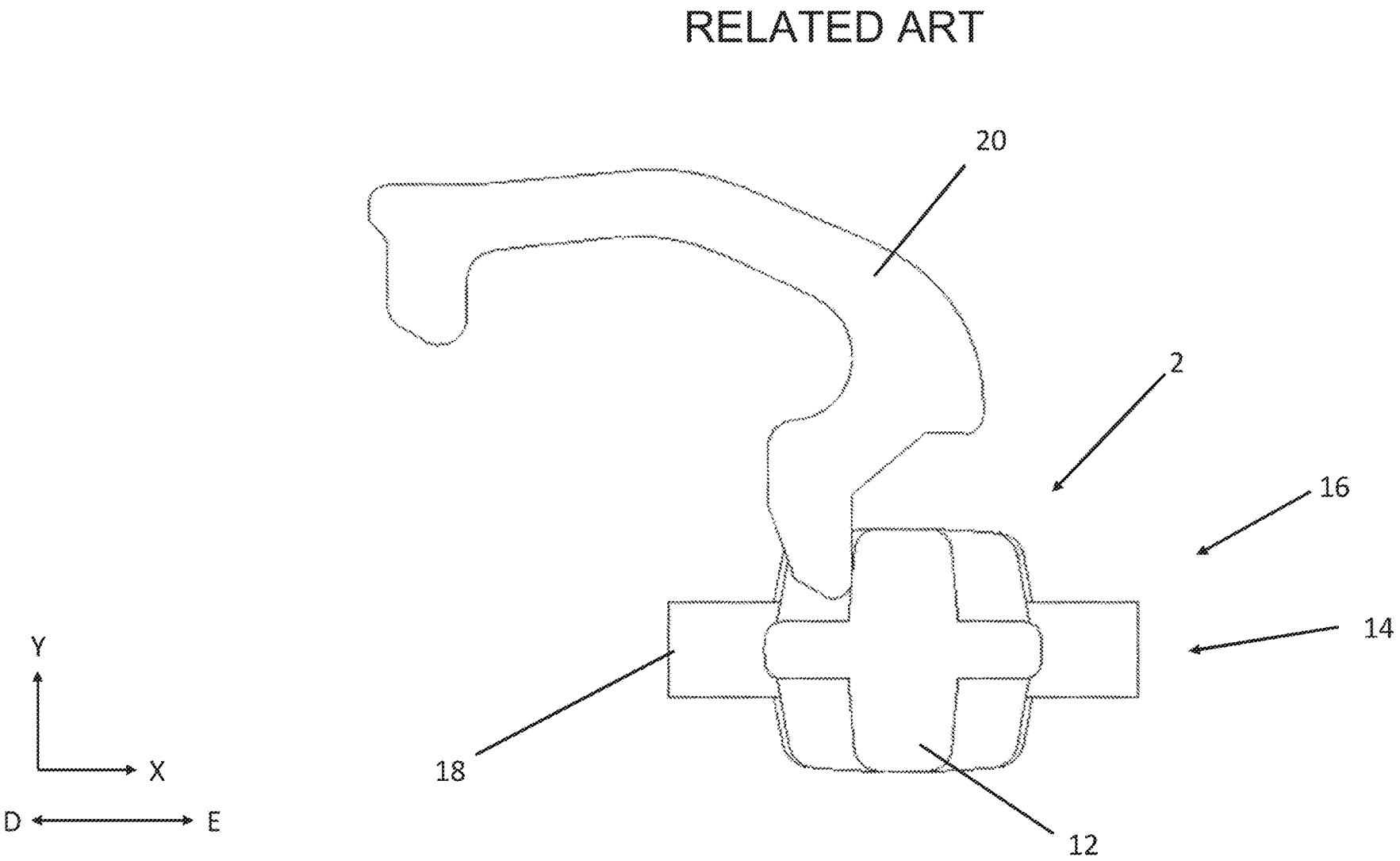
FIG. 2 shows a side view of stringer of a slide fastener that includes a locking pin and the coupling element of FIG. 1.

FIG. 2 shows a cross-sectional side view of the known coupling element 2 mounted on to a stringer 14 of a slide fastener 16. The cross-sectional for the view of FIG. 2 has been taken through the neck 12 of the coupling element 2, in a plane perpendicular to the lateral axis Z. The plane of the cross-sectional view extends through a middle region, in the direction of the lateral axis Z, region of the neck 12.

The coupling element 2 is mounted to a fastener tape 18 of the stringer 14. Further coupling elements are mounted to the fastener tape 18 but are not shown in FIG. 2 for clarity. As can be seen, the slide fastener 16 comprises a slider (not depicted in full, a body of the slider has removed for clarity) that comprises a locking pin 20. The slider is movable in a first direction D to couple, or interdigitate, the coupling elements 2 of the stringer 14 with corresponding coupling elements of a second stringer (not depicted) along a fastener axis (not depicted). The slider 14 is movable in a second direction E, opposite to the first direction D, to decouple the coupling elements. The locking pin 20 is movable between a first position in which it engages one or more coupling elements 2, and a second position in which it is disengaged from the coupling elements. The position of the locking pin 20 is controlled by a user. The rest position for the locking pin 20 is the first position. To move the locking pin to the second position, the user moves a pull (not shown in FIG. 2) of the slider, as is known in the art.

In FIG. 2, the locking pin 20 is in the first position. In the first position, the locking pin 20 engages the neck 12 of the coupling element 2. With the locking pin 20 in the first position, the slider is prevented from moving along the fastener axis due to the engagement with the coupling element 2. However, if a load to move the slider exceeds a first threshold value, the locking pin 20 can tear one or more coupling elements 2 off the stringer. Furthermore, one or more coupling elements 2 may tear from the stringer if repeatedly subjected to a load below the first threshold value but greater than a second threshold value. The second threshold value is less than the first threshold value. It is undesirable for one or more coupling elements 2 to be torn from the stringer because, with one or more coupling elements 2 missing, the slide fastener is no longer usable and would need replacing. The present invention seeks to obviate, or at least mitigate, the problems associated with known slide fasteners, whether identified herein or otherwise.

Figure 3:
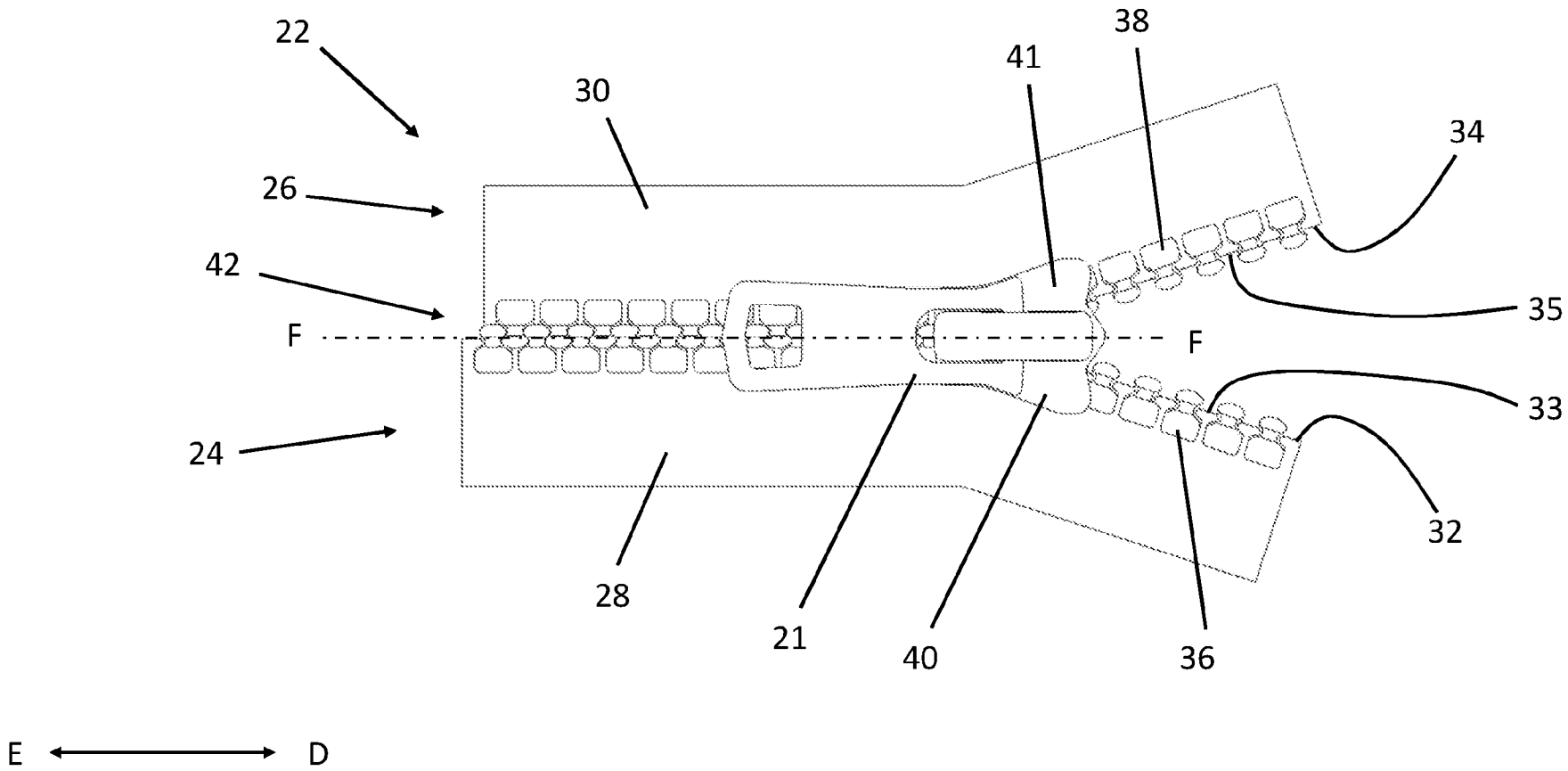
FIG. 3 shows a slide fastener according to an embodiment of the present invention.

FIG. 3 shows a portion of a slide fastener 22 according to an embodiment of the present invention. The slide fastener 22 is a waterproof slide fastener. However, in other embodiments, the slide fastener need not be waterproof. The slide fastener 22 comprises a first stringer 24 and a second stringer 26. The stringers 24, 26 comprise a respective fastener tape 28, 30. The fastener tapes 28, 30 may be woven or knitted. The tapes may have another plastic layer on one or both sides to enhance the waterproof function. The fastener tapes 28, 30 define a respective longitudinal edge 32, 34. The longitudinal edges 32, 34 comprise a respective cord 33, 35. The cords 33, 35 are woven, knitted, and/or incorporated at the longitudinal edge 32, 34 of the respective fastener tape 28, 30. Disposed along each longitudinal edge 32, 34 are a respective plurality of coupling elements 36, 38. The slide fastener 22 further comprises a slider 40. The slider 40 comprises a body 41. The slider 40 comprises a locking pin (not visible in FIG. 3, it is hidden inside the slider). The slider may be a slider as described in EP3656243A1, which is incorporated herein by reference. In particular paragraphs 10 to 17, and 27 to 56, and FIGS. 1 to 5 of EP3656243A1 which relate to the slider, are incorporated by reference. The slider 40 is moveable in a first direction D and in a second direction E. The second direction E is opposite to the first direction D. Movement of the slider 40 in the first direction D couples, by interdigitating, the coupling elements 36 of the first stringer 24 with the coupling elements 38 of the second stringer 26 along a fastener axis F to form a chain 42. With the pluralities of coupling elements 36, 38 coupled to one another, the cords 33, 35 seal against one another such that the slide fastener is waterproof. However, as discussed above, this need not be the case, and the cords 33, 35 may be spaced apart from one another when the coupling elements 36, 38 are coupled to one another. Where the slide fastener 22 is waterproof, the sealing pressure that the cords 33, 35 exert on one another is generally greater than where the slide fastener 22 is not waterproof. Movement in the second direction E decouples the coupling elements 36 of the first stringer 24 from the coupling elements 38 of the second stringer 26. The locking pin is moveable between a first position and a second position. The position of the locking pin is controlled by a user. The rest position for the locking pin is the first position. The position of the locking pin is controllable with a pull 21 of the slider 40, as is known in the art. In the first position, the locking pin is engageable with one or more coupling elements of the plurality of coupling elements 36 of the first stringer 24. In the second position, the locking pin is spaced apart from the coupling elements of the plurality of coupling elements 36 of the first stringer 24.

In some, non-depicted, embodiments, the slide fastener 22 may comprise a second slider. The second slider is positioned beneath, along the fastener axis F, the slider 40. The second slider may also comprise a locking pin. The second slider may be configured such that, movement of the second slider in the first direction D, decouples the coupling elements 36 of the first stringer 24 from the coupling elements 38 of the second stringer 26. The second slider may be configured such that movement of the slider in the second direction E couples, by interdigitating, the coupling elements 36 of the first stringer 24 with the coupling elements 38 of the second stringer 26. In the first position, the locking pin of the second slider may be engageable with one or more coupling elements of the coupling elements 38 of the second stringer 26. In the second position, the locking pin of the second slider is spaced apart from the coupling elements 38 of the second stringer 26.

Figure 4:
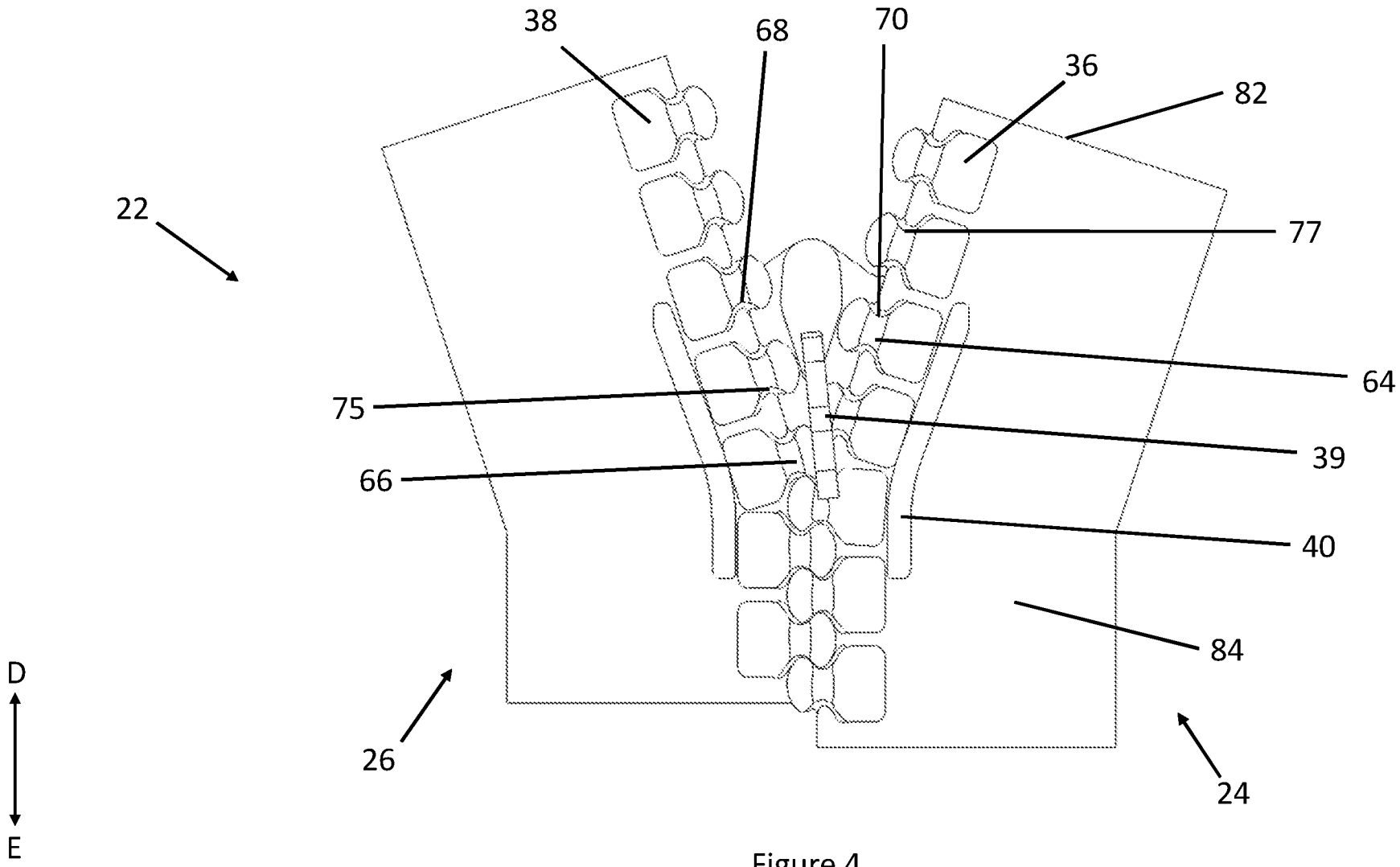
FIG. 4 shows a partial cross-sectional view of the slide fastener of FIG. 3.

FIG. 4 shows a partial cross-sectional view the slide fastener 22 of FIG. 3. In FIG. 4, a front side 84 of the slide fastener 22 can be seen. The plane of the cross-section of FIG. 4 extends through the slider 40 such that the position of the locking pin 39 can be seen. In FIG. 4, the locking pin 39 is in the first position. As can be seen, in the first position, the locking pin 39 engages a coupling element of the plurality of coupling elements 36 of the first stringer 24. In some embodiments, in the first position, the locking pin 39 may engage a coupling element of the plurality of coupling elements 38 of the second stringer 26. It will be appreciated that moving the locking pin 39 to the first position does not necessarily result in the immediate engagement of a coupling element of one of the pluralities of coupling elements 36, 38. That is to say, upon moving the locking pin 39 to the first position, some movement of the slider 40 in the second direction E may be required before the locking pin engages a coupling element of one of the pluralities of coupling elements 36, 38.

Figure 5:
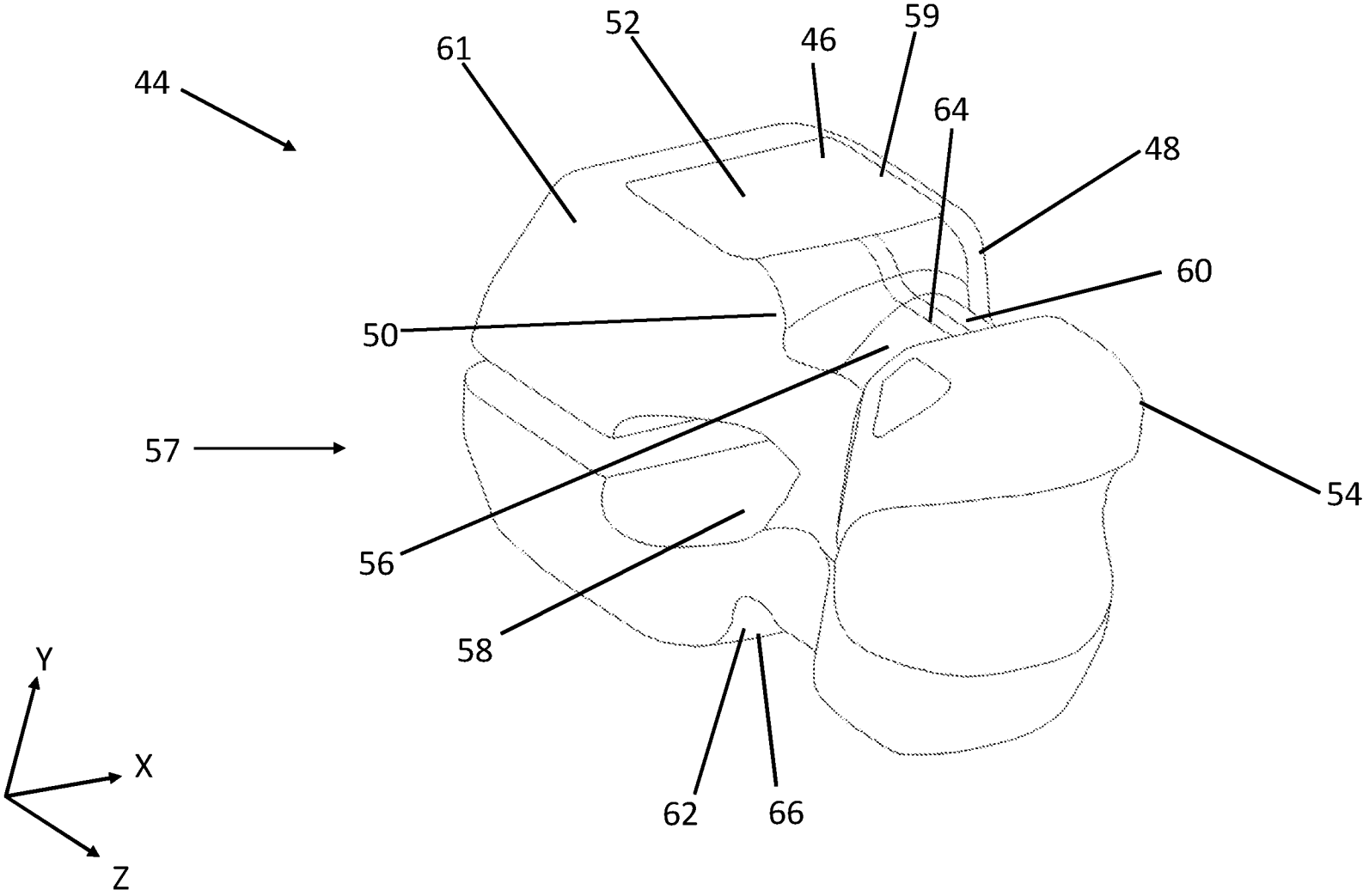
FIG. 5 shows a perspective view of a coupling element of the slide fastener of FIG. 3.

FIG. 5 shows a coupling element 44 of the pluralities of coupling elements 36, 38. The coupling element 44 comprises a main body (or body) 46. In use, the main body 46 is mounted to one of the fastener tapes of the slide fastener depicted in FIG. 3. The main body 46 may be mounted to the fastener tape by injection moulding it directly onto the fastener tape. The main body 46 comprises shoulder portions 48, 50. The shoulder portions 48, 50 are spaced apart from one another. The shoulder portions 48, 50 are spaced apart from one another in a direction parallel to a longitudinal axis X. The body 46 comprises an upper surface 52 and a lower surface (not visible in FIG. 5—it is hidden behind the body 46).

The coupling element 44 comprises a head (or head portion) 54. The head 54 extends parallel to a lateral axis Z. The lateral axis Z is perpendicular to the longitudinal axis X. The coupling element 44 comprises a neck 56. The neck 56 is located between the shoulder portions 48, 50. The head portion 54 extends away from the shoulder portions 48, 50 via the neck 56. The neck 56 defines an upper surface 60 and a lower surface 62. The upper surface 60 and lower surface 62 are convex or at least partly convex. The neck 56 extends in a direction parallel to the lateral axis Z.

The coupling element 44 defines a proximal portion 57. The proximal portion 57 comprises the main body 46 and the neck 56. The proximal portion 57 is called so due to it being proximal to the fastener tape when mounted thereon. The proximal portion 57 defines a first portion 59. The proximal portion 57 defines a second portion 61. The second portion 61 is disposed along the longitudinal axis X, adjacent to the first portion 59. In some embodiments, the first portion 59 and the second portion 61 may each comprise 50% of the proximal portion 57. The first portion 59 and the second portion 61 may each comprise 50% of the volume of the proximal portion 57. The first portion 59 and the second portion 61 may each comprise 50% of the length of the proximal portion 57 in a direction parallel to the longitudinal axis X. In particular, a plane at the interface between the first portion 59 and the second portion 61 may extend parallel to the lateral axis Z and be disposed at a midpoint of the proximal portion 57 in a direction parallel to the longitudinal axis X.

The first portion 59 comprises a part that adjoins an upper surface 47 of the fastener tape 45 and a part that adjoins a lower surface 49 of the fastener tape 45. The second portion 61 comprises a part that adjoins an upper surface 47 of the fastener tape 45 and a part that adjoins a lower surface 49 of the fastener tape 45. However, in some embodiments, at least part of all of the first portion 59 and/or at least part or all of the second portion 61 may extend continuously in the direction of the normal axis Y—that is to say, in some embodiments at least part of all of the first and/or second portion may not have fastener tape passing through it. Put another way, at least part or all of the first portion 59 and/or at least part or all of the second portion 61 may extend through the fastener tape. This may improve the strength of the connection between the coupling element 44 and the fastener tape.

The coupling element 44 comprises a cord receiving portion 58. The cord receiving portion 58 extends through the body 46 and the neck 56. The cord receiving portion 58 extends in a direction parallel to the longitudinal axis X. When the coupling element 44 is mounted onto a fastener tape, the cord of the fastener tape extends through the cord receiving portion 58. The interlock between the cord receiving portion 58 of the coupling element 44 and the cord of the fastener tape increases the force acting in a direction parallel to the lateral axis Z required to tear the coupling element 44 off the fastener tape. This is as compared to if no interlock were present. In some embodiments, the cord receiving portion 58 may extend only through the body 46. The position of the cord receiving portion 58 is determined by the desired characteristics of the slide fastener to which the coupling element is to be mounted. For example, where the slide fastener is not a waterproof slide fastener, the cord receiving portion 58 may extend only through the body 46.

The neck 56 comprises an upper groove 64. In other embodiments, discussed below, the upper groove 64 may be formed in the main body 46. The upper groove 64 extends parallel to the longitudinal axis X. The upper groove 64 extends along the upper surface 60 of the neck 56. The neck 56 comprises a lower groove 66. In other embodiments, discussed below, the lower groove 66 may be formed in the main body 46. The lower groove 66 extends parallel to the longitudinal axis X. The lower groove 66 extends along the lower surface 62 of the neck 56. As will be discussed in more detail below, the neck 56 is designed such that a locking pin of a slider passes over the neck once a force acting to move the slider in the second direction (i.e., the direction in which the slider decouples the coupling elements) exceeds a predetermined value. In some embodiments, the predetermined value may be at least 35N and/or up to 75N. In some embodiments, the predetermined value may be at least 20N and/or up to 150N. The magnitude of the predetermined value is a function of, among other things, the size of the slide fastener on to which the coupling element 44 is mounted, which includes the size of the coupling element 44, and the type of slide fastener on to which the coupling element 44 is mounted.

Figure 6:
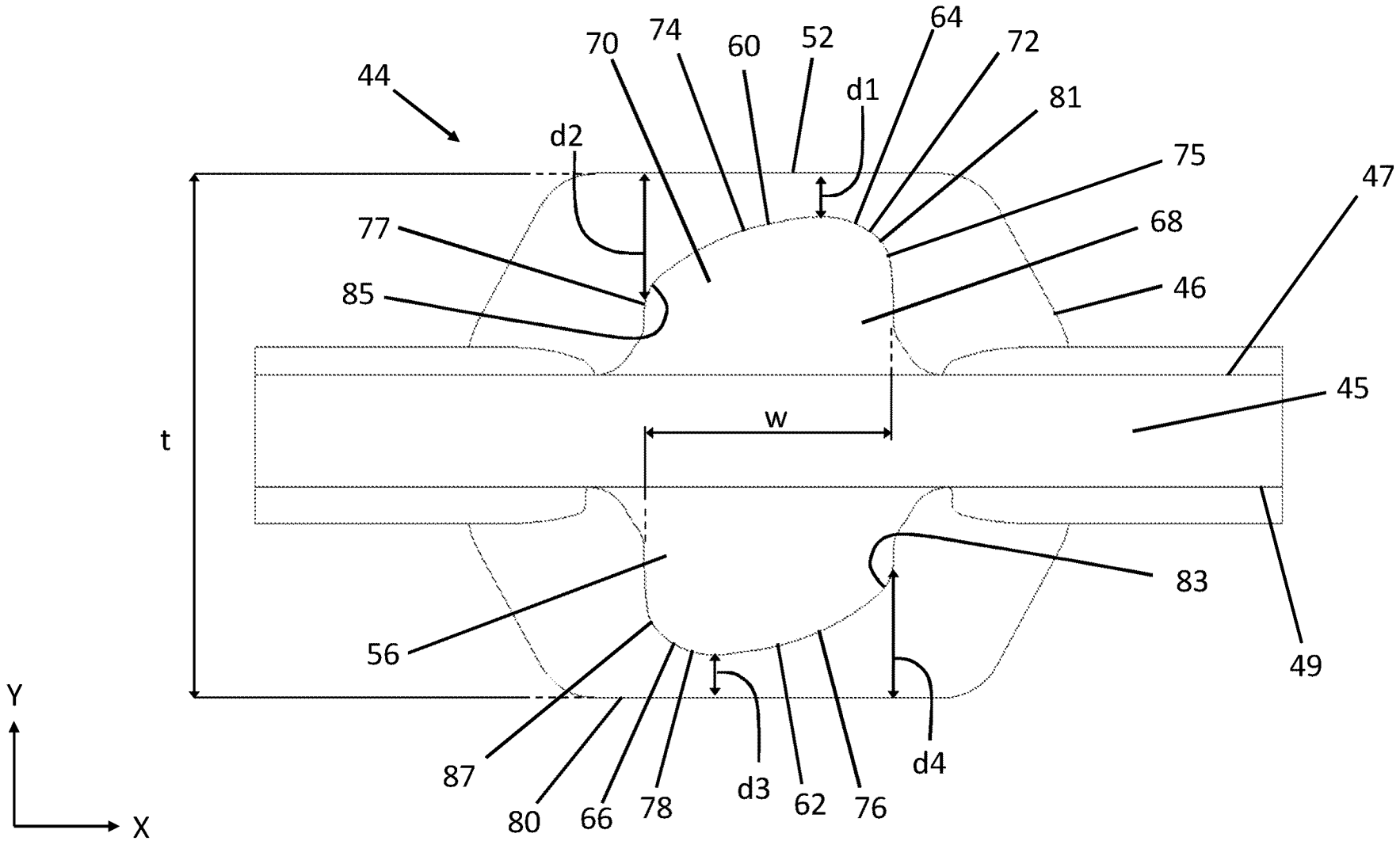
FIG. 6 shows a cross-sectional view of the coupling element of FIG. 5.

FIG. 6 shows a cross-sectional view of the coupling element 44 in a plane perpendicular to the lateral axis (which extends out of the page of FIG. 6). FIG. 6 shows the coupling element mounted on to a fastener tape 45. The cross-section for the view of FIG. 6 has been taken through the neck 56 of the coupling element 44. The plane of the cross-sectional view extends through a middle region, in the direction of the lateral axis Z, of the neck 56. As can be seen, the neck 56 is generally parallelogram-shaped in a cross-sectional plane that is perpendicular to the lateral axis. The neck 56 comprises a first neck portion 68. The first neck portion 68 forms a part of the first portion 59 of the proximal portion 57. The neck 56 comprises a second neck portion 70.

. The second neck portion 70 forms a part of the second portion 61 of the proximal portion 57. The second neck portion 70 is disposed along the longitudinal axis X, adjacent to the first neck portion 68. In some embodiments, the first neck portion 68 and the second neck portion 70 may each comprise 50% of the neck 54 in a direction parallel to the longitudinal axis X. In some embodiments, the first neck portion 68 and the second neck portion 70 may each comprise 50% of the neck 54. The first neck portion 68 and the second neck portion 70 may each comprise 50% of the volume of the neck 54. The first neck portion 68 and the second neck portion 70 may each comprise 50% of the length of the neck 54 in a direction parallel to the longitudinal axis X. In particular, a plane at the interface between the first neck portion 68 and the second neck portion 70 may extend parallel to the lateral axis Z and be disposed at a midpoint of the neck 54 in a direction parallel to the longitudinal axis X.

The first neck portion 68 comprises a part that adjoins an upper surface 47 of the fastener tape 45 and a part that adjoins a lower surface 49 of the fastener tape 45. The second neck portion 70 comprises a part that adjoins an upper surface 47 of the fastener tape 45 and a part that adjoins a lower surface 49 of the fastener tape 45. However, in some embodiments, the first neck portion 68 and/or second neck portion 70 may extend continuously in the direction of the normal axis Y.

The first neck portion 68 defines a first end 75 in a direction parallel to the longitudinal axis X. The first end 75 is a first end of the neck 56. The first end 75 may be an end region, or end-point. The first end 75 is defined between a first point and a second point. The first point is disposed at the location at which, when starting from a midpoint along the longitudinal axis X of the upper surface 60 of the neck 56 and moving in a direction parallel to the longitudinal axis X and away from the second neck portion 70, an angle between a normal extending from the upper surface 60 of the neck 56 and the longitudinal axis X is less than 15 degrees. The second point is disposed at the location at which, when starting from a midpoint along the longitudinal axis X of the lower surface 62 of the neck 56 and moving in a direction parallel to the longitudinal axis X and away from the second neck portion 70, an angle between a normal extending from the lower surface 62 of the neck 56 and the longitudinal axis X is less than 15 degrees. Here, the angle between the normal extending from the upper surface 60 of the neck 56 and the longitudinal axis X refers to the acute angle, and not obtuse angle, that is formed between the normal and the longitudinal axis. At least part of the first end 75 extends parallel to the normal axis Y. However, in some embodiments, the first end 75 may be non-parallel with the normal axis Y.

The upper surface 60 of the neck 56 merges into the first end 75 via a first transition portion 81. The first transition portion 81 is radiused. However, in other, non-depicted, embodiments, the first transition portion 81 may be of any suitable geometry. For example, the first transition portion 81 may define a vertex or chamfer. The lower surface 62 of the neck 56 merges into the first end 75 via a second transition portion 83. The second transition portion 83 is radiused. However, in other, non-depicted, embodiments, the second transition portion 83 may be of any suitable geometry. For example, the second transition portion 83 may define a vertex or chamfer.

The second neck portion 70 defines a second end 77 in a direction parallel to the longitudinal axis X. The second end 77 is a second end of the neck 56. The second end 77 may be an end region, or end-point. The second end 77 is defined between a first point and a second point. The first point is disposed at the location at which, when starting from a midpoint along the longitudinal axis X of the lower surface 62 of the neck 56 and moving in a direction parallel to the longitudinal axis X and away from the first neck portion 68, an angle between a normal extending from the lower surface 62 of the neck 56 and the longitudinal axis X is less than 15 degrees. The second point is disposed at the location at which, when starting from a midpoint along the longitudinal axis X of the lower surface 62 of the neck 56 and moving in a direction parallel to the longitudinal axis X and away from the first neck portion 68, an angle between a normal extending from the upper surface 60 of the neck 56 and the longitudinal axis X is less than 15 degrees. Here, the angle between the normal extending from the upper surface 60 or lower surface 62 of the neck 56 and the longitudinal axis X refers to the acute angle, and not obtuse angle, that is formed. At least part of the second end 77 extends parallel to the normal axis Y. However, in some embodiments, the second end 77 may be non-parallel with the normal axis Y.

The upper surface 60 of the neck 56 merges into the second end 77 via a third transition portion 85. The third transition portion 85 is radiused. However, in other, non-depicted, embodiments, the third transition portion 85 may be of any suitable geometry. For example, the third transition portion 85 may define a vertex or chamfer. The lower surface 62 of the neck 56 merges into the second end 77 via a fourth transition portion 87. The fourth transition portion 87 is radiused. However, in other, non-depicted, embodiments, the fourth transition portion 87 may be of any suitable geometry. For example, the fourth transition portion 87 may define a vertex or chamfer.

The neck 56 defines a width w. The width w of the neck 56 extends from the first end 75 of the first neck portion 68 to the second end 77 of the second neck portion 70 in a direction parallel to the longitudinal axis X.

The upper groove 64 comprises a first groove portion 72 in the region of the first neck portion 68. The upper groove 64 comprises a second groove portion 74 in the region of the second neck portion 70. A depth of any point of the first groove portion 72 or of the second groove portion 74 may be understood to refer to a distance in a direction parallel to a normal axis Y, perpendicular to both the longitudinal axis X and to the lateral axis, from the upper surface 52 of the body 46 of the coupling element 44 to the upper surface 60. The first groove portion 72 defines a minimum depth d1. The minimum depth d1 of the first groove portion 72 is a minimum depth of the upper groove 64. The minimum depth d1 of the first groove portion 72 is less than the depth of the entirety of the second groove portion 74 of the upper groove 64. In some embodiments, the minimum depth d1 may be zero. The predetermined force for a locking pin of a slider to pass over the neck 56 is a function of the minimum depth d1.

The second groove portion 74 of the upper groove 64 defines a maximum depth d2. The maximum depth d2 of the second groove portion 74 is a maximum depth of the upper groove 64. The maximum depth d2 of the second groove portion 74 is greater than the depth of the entirety of the first groove portion 72 of the upper groove 64. However, in some embodiments, the maximum depth d2 of the second groove portion 74 may be equal to the depth of at least part of the first groove portion 72 of the upper groove 64. However, where the maximum depth d2 of the second groove portion 74 of the upper groove 64 is equal to the depth of at least part of the first groove portion 72 of the upper groove 64, the depth of at least part of the first groove portion 72 may be less than the depth of at least part of the second groove portion 74. The predetermined force for a locking pin of a slider to pass over the neck 56 is a function of the maximum depth d2. In particular, the greater the magnitude of the maximum depth d2, the smaller the magnitude of the predetermined force required for a locking pin of a slider to pass over the upper surface 60 of the neck 56, and the smaller the magnitude of the maximum depth d2, the greater the magnitude of the predetermined force required for a locking pin of a slider to pass over the upper surface 60 of the neck 56.

The maximum depth d2 of the second groove portion 74 of the upper groove 64 is at least 15% greater than the minimum depth d1 of the first groove portion 72 of the upper groove 64. Thus a minimum depth differential between the minimum depth d1 of the first groove portion 72 of the upper groove 64 and the maximum depth d2 of the second groove portion 74 of the upper groove 64 is provided. The force required for a locking pin of a slider to pass over the upper groove 64 is a function of the minimum depth d1, the maximum depth d2, and the difference between the minimum depth d1 and the maximum depth d2. The force required for a locking pin of a slider to pass over the upper groove 64 increases with an increasing difference between the minimum depth d1 and the maximum depth d2. However, other factors, such as the geometry of the locking pin, influence the force required for a locking pin of a slider to pass over the upper groove 64. The maximum depth d2 being at least 15% greater than the minimum depth d1 advantageously facilitates passage of a locking pin of a slider over the neck 56. However, in some embodiments, the maximum depth d2 of the second groove portion 74 of the upper groove 64 may be less than 15% greater than the minimum depth d1 of the first groove portion 72 of the upper groove 64.

The maximum depth d2 of the second groove portion 74 of the upper groove 64 is up to seven times greater than the minimum depth d1 of the first groove portion 72 of the upper groove 64. As discussed above, the force required for a locking pin of a slider to pass over the upper groove 64 is a function of the difference between the minimum depth d1 and the maximum depth d2. Where the maximum depth d2 is more than seven times greater than the minimum depth d1, the likelihood of the locking pin of a slider unintentionally passing over the upper groove 64 exceeds an acceptable value. However, in some embodiments, the maximum depth d2 of the second groove portion 74 of the upper groove 64 may be more than seven times greater than the minimum depth d1 of the first groove portion 72 of the upper groove 64.

The position of the minimum depth d1 of the first groove portion 72 of the upper groove 64 is offset from the first end 75 of the first neck portion 68. The position of the minimum depth d1 of the first groove portion 72 of the upper groove 64 is offset from the first end 75 of the first neck portion 68 in a direction parallel to the longitudinal axis X. The distance by which the position of the minimum depth d1 is offset from the first end 75 of the first neck portion 68 is at least 10% of the width w of the neck 56. The distance by which the position of the minimum depth d1 is offset from the first end 75 of the first neck portion 68 is up to 50% of the width w of the neck 56. In some embodiments, the position of the minimum depth d1 may not be offset from the first end 75 of the first neck portion 68.

The body 46 defines a thickness t. The thickness t of the body 46 is measured from the upper surface 52 of the body 46 to the lower surface 80 of the body 46. The thickness t of the body 46 is measured in a direction parallel to the normal axis Y. The maximum depth d2 of the second groove portion 74 of the upper groove 64 is at least 5% of the thickness t of the body 46. The maximum depth d2 of the second groove portion 74 of the upper groove 64 is up to 30% of the thickness t of the body 46. The maximum depth d2 of the second groove portion 74 being up to 30% of the thickness t of the body 46 advantageously provides the neck 56 with additional strength, as compared to where the maximum depth d2 of the second groove portion 74 is more than 30% of the thickness t of the body 46. This additional strength reduces deformation of the neck 56 when subject to a force that acts on the head 54 and/or neck 56 in a direction parallel to the lateral axis Z and away from the body 46. In addition, in some applications, it may be desirable to remove one or more coupling elements from a stringer. The additional strength of the neck 56 reduces the likelihood that only the head and part or all of the neck is removed, leaving the body 46 affixed to the fastener tape of the stringer. In addition, the maximum depth d2 being up to 30% of the thickness t of the body 46 advantageously reduces the likelihood of a locking pin of a slider inadvertently passing over the neck 56. The maximum depth d2 being at least 5% of the thickness t of the body 46 advantageously reduces the likelihood of the coupling element 44 being removed from the fastener tape by a load exerted on the coupling element by a locking pin of a slider. In some embodiments, the maximum depth d2 of the second groove portion 74 of the upper groove 64 may be less than 5%, or more than 30%, of the thickness t of the body 46.

The lower groove 66 comprises a first groove portion 76 in the region of the first neck portion 68. The lower groove 64 comprises a second groove portion 78 in the region of the second neck portion 70. A depth of any point of the first groove portion 76 or of the second groove portion 78 may be understood to refer to a distance in a direction parallel to the normal axis Y from the lower surface 80 of the body 46 of the coupling element 44 to the lower surface 62 of the neck 56. The second groove portion 78 defines a minimum depth d3. The minimum depth d3 of the second groove portion 78 is a minimum depth of the lower groove 66. The minimum depth d3 of the second groove portion 78 is less than the depth of the entirety of the first groove portion 76 of the lower groove 66. The predetermined force for a locking pin of a slider to pass over the neck 56 is a function of the minimum depth d3.

The minimum depth d3 of the second groove portion 78 of the lower groove 66 being less than the depth of the entirety of the first groove portion 76 of the lower groove 66 advantageously results in the shape of the neck 56 being more uniform. To affix a coupling element 44 to a fastener tape, the coupling element 44 is injection moulded on to a moving fastener tape. While affixing the coupling element 44 to a fastener tape, the head 54 and neck 56 of the coupling element are urged in a direction opposite to the direction of motion of the fastener tape. Where the second neck portion 70 trails the first neck portion 68, the minimum depth d3 of the second groove portion 78 provides the neck 56 with additional strength to resist deformation in a direction that is opposite to the direction of motion of the fastener tape. This results in a more uniformly shaped neck 56.

The first groove portion 76 of the lower groove 66 defines a maximum depth d4. The maximum depth d4 of the first groove portion 76 is a maximum depth of the lower groove 66. The maximum depth d4 of the first groove portion 76 is greater than the depth of the entirety of the second groove portion 78 of the lower groove 66. However, in some embodiments, the maximum depth d4 of the first groove portion 76 may be equal to the depth of at least part of the second groove portion 78 of the lower groove 66. However, where the maximum depth d4 of the first groove portion 76 of the lower groove 66 is equal to the depth of at least part of the second groove portion 78 of the lower groove 66, the depth of at least part of the second groove portion 78 may be less than the depth of at least part of the first groove portion 76. The predetermined force for a locking pin of a slider to pass over the neck 56 is a function of the maximum depth d4. In particular, the greater the magnitude of the maximum depth d4, the smaller the magnitude of the predetermined force required for a locking pin of a slider to pass over the lower surface 62 of the neck 56, and the smaller the magnitude of the maximum depth d4, the greater the magnitude of the predetermined force required for a locking pin of a slider to pass over the lower surface 62 of the neck 56.

The maximum depth d4 of the first groove portion 76 of the lower groove 66 is at least 15% greater than the minimum depth d3 of the second groove portion 78 of the lower groove 66. Thus, a minimum depth differential between the minimum depth d3 of the second groove portion 78 of the lower groove 66 and the maximum depth d4 of the first groove portion 76 of the lower groove 66 is provided. The force required for a locking pin of a slider to pass over the lower groove 66 is a function of the minimum depth d3, the maximum depth d4, and the difference between the minimum depth d3 and the maximum depth d4. The force required for a locking pin of a slider to pass over the lower groove 66 increases with an increasing difference between the minimum depth d3 and the maximum depth d4. However, other factors, such as the geometry of the locking pin, influence the force required for a locking pin of a slider to pass over the lower groove 66. The maximum depth d4 being at least 15% greater than the minimum depth d3 advantageously facilitates passage of a locking pin of a slider over the neck 56. It is desirable for this advantage to be provided by the lower groove 66 because the coupling element 44 can be mounted on to a fastener tape in one of two possible orientations, as will be discussed below. However, in some embodiments, the maximum depth d4 of the first groove portion 76 of the lower groove 66 may be less than 15% greater than the minimum depth d3 of the second groove portion 76 of the lower groove 66.

The maximum depth d4 of the first groove portion 76 of the lower groove 66 is up to seven times greater than the minimum depth d3 of the second groove portion 78 of the lower groove 66. As discussed above, the force required for a locking pin of a slider to pass over the lower groove 66 is a function of the difference between the minimum depth d3 and the maximum depth d4. Where the maximum depth d4 is more than seven times greater than the minimum depth d3, the likelihood of the locking pin of a slider unintentionally passing over the lower groove 66 exceeds an acceptable value. However, in some embodiments, the maximum depth d4 of the first groove portion 76 of the lower groove 66 may be more than seven times greater than the minimum depth d3 of the second groove portion 78 of the lower groove 66.

The maximum depth d4 of the first groove portion 76 of the lower groove 66 is at least 5% of the thickness t of the body 46. The maximum depth d4 of the first groove portion 76 of the lower groove 66 is up to 30% of the thickness t of the body 46. The maximum depth d4 of the second groove portion 74 being up to 30% of the thickness t of the body 46 advantageously provides the neck 56 with additional strength, as compared to where the maximum depth d4 of the first groove portion 76 is more than 30% of the thickness t of the body 46. This additional strength reduces deformation of the neck 56 when subject to a force that acts on the head 54 and/or neck 56 in a direction parallel to the lateral axis Z and away from the body 46. In addition, in some applications, a user may wish to remove one or more coupling elements from a stringer. The additional strength of the neck 56 reduces the likelihood that only the head and part or all of the neck is removed, leaving the body 46 affixed to the fastener tape of the stringer. In addition, the maximum depth d4 being up to 30% of the thickness t of the body 46 advantageously reduces the likelihood of a locking pin of a slider inadvertently passing over the neck 56. The maximum depth d4 being at least 5% of the thickness t of the body 46 advantageously reduces the likelihood of the coupling element 44 being removed from the fastener tape by a load exerted on the coupling element by a locking pin of a slider. However, in some embodiments, the maximum depth d4 of the first groove portion 76 of the lower groove 66 may be less than 5%, or more than 30%, of the thickness t of the body 46.

The position of the minimum depth d3 of the second groove portion 78 of the lower groove 66 is offset from the second end 77 of the second neck portion 70. The position of the minimum depth d3 of the second groove portion 78 of the lower groove 66 is offset from the second end 77 of the second neck portion 70 in a direction parallel to the longitudinal axis X. The distance by which the position of the minimum depth d3 is offset from the second end 77 of the second neck portion 70 is at least 10% of the width w of the neck 56. The distance by which the position of the minimum depth d3 is offset from the second end 77 of the second neck portion 70 is up to 50% of the width w of the neck 56. In some embodiments, the position of the minimum depth d3 may not be offset from the second end 77 of the second neck portion 70.

The minimum depth d1 of the first groove portion 72 of the upper groove 64 is less than the depth of the entirety of the first groove portion 76 of the lower groove 66. This can be the case where the neck 56 is not rotationally symmetric, and where the neck 56 is rotationally symmetric. The minimum depth d3 of the second groove portion 78 of the lower groove 66 is less than the depth of the entirety of the second groove portion 74 of the upper groove 64. This can be the case where the neck 56 is not rotationally symmetric, and where the neck 56 is rotationally symmetric.

Conventionally, to affix coupling elements to a fastener tape, the coupling elements are injection moulded on to a fastener tape. Once two fastener tapes have been provided with adequate coupling elements, the coupling elements are interdigitated. If the coupling elements have not cooled sufficiently upon interdigitation, the coupling elements can deform. The minimum depth d1 of the first groove portion 72 of the upper groove 64 being less than the depth of the entirety of the first groove portion 76 of the lower groove, and the minimum depth d3 of the second groove portion 76 of the lower groove 64 being less than the depth of the entirety of the second groove portion 74 of the upper groove 64, advantageously reduces or eliminates such deformation. This is because the reduced areas of the neck 56 formed as a result of the geometry of the second groove portion 74 of the upper groove 64, and of the first groove portion 76 of the lower groove 66 are compensated for by the increased area of the neck 56 formed as a result of the geometry of the first groove portion 72 of the upper groove 64, and by the second groove portion 78 of the lower groove 66. This provides the neck 56 of the coupling element 44 with the strength to withstand being coupled with one or more coupling elements without, or with significantly reduced, deformation.

As can be seen from the cross-sectional view of FIG. 6, the neck 56 is rotationally symmetric when viewed in a cross-sectional plane that is perpendicular to the lateral axis Z (as is the case for the cross-sectional view of FIG. 6). The neck 56 is rotationally symmetric along at least 25% of the length of the neck 56. The length of the neck 56 extends in a direction parallel to the lateral axis, which extends out of the page of FIG. 6. In some, non-depicted, embodiments, the neck 56 may be rotationally symmetric in at least one cross-sectional plane that is perpendicular to the lateral axis. In the depicted embodiment, the rotational symmetry of the neck 56 has an order of two. However, in some, non-depicted embodiments, the order of rotational symmetry of the neck 56 may be more than two. Advantageously, the neck 56 being rotationally symmetric allows the stringer on to which the coupling element 44 is mounted to be affixed to an article in the two possible orientations without impacting the performance of the stringer, as will be discussed in more detail below.

Figure 7:
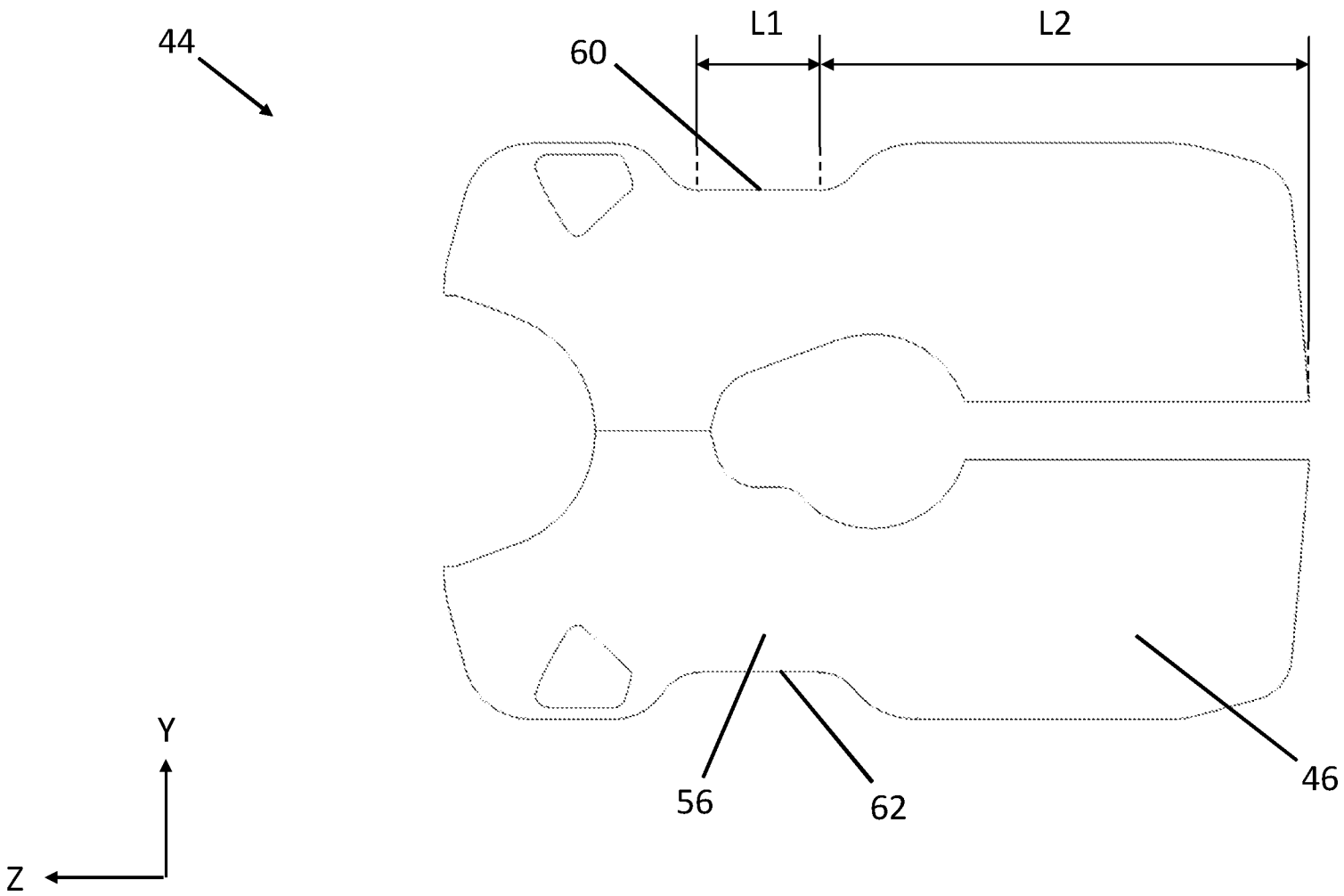
FIG. 7 shows a side view of the coupling element of FIG. 5.

Referring now to FIG. 7. As discussed above, the neck 56 of the coupling element 44 defines a length L1. The length L1 of the neck 56 extends parallel to the lateral axis Z. The length L1 of the neck 56 is measured along the portion of the neck 56 that is parallel to the lateral axis Z. In embodiments where no portion of the neck 56 is parallel to the lateral axis Z, the length L1 of the neck 56 is measured along the thinnest portion of the neck 56 in a direction parallel to the lateral axis Z. The thinnest portion of the neck 56 is the portion having the smallest distance from the upper surface 60 of the neck 56 to the lower surface 62 of the neck 56 in a direction parallel to the normal axis Y. The body 46 defines a length L2. The length of the body 46 extends parallel to the lateral axis Z. The body 46 adjoins the neck 56. Therefore, the length of the body 46 is measured from the point at which the body 46 and neck 56 interface one another to a rearmost point of the body 46. The rearmost point of the body 46 refers to the point of the body that is disposed furthest away from the neck 56 in a direction that is parallel to the lateral axis Z. The length L1 of the neck 56 is up to 65% of the length L2 of the body 46. This advantageously reduces the likelihood of the coupling element 44 becoming detached in use from a stringer onto which it is mounted. In some embodiments, the length L1 of the neck 56 may be at least 5% of the length L2 of the body 46. In some embodiments, the length L1 of the neck 56 may less than 5% or more than 65% of the length L2 of the body 46.

Figure 8:
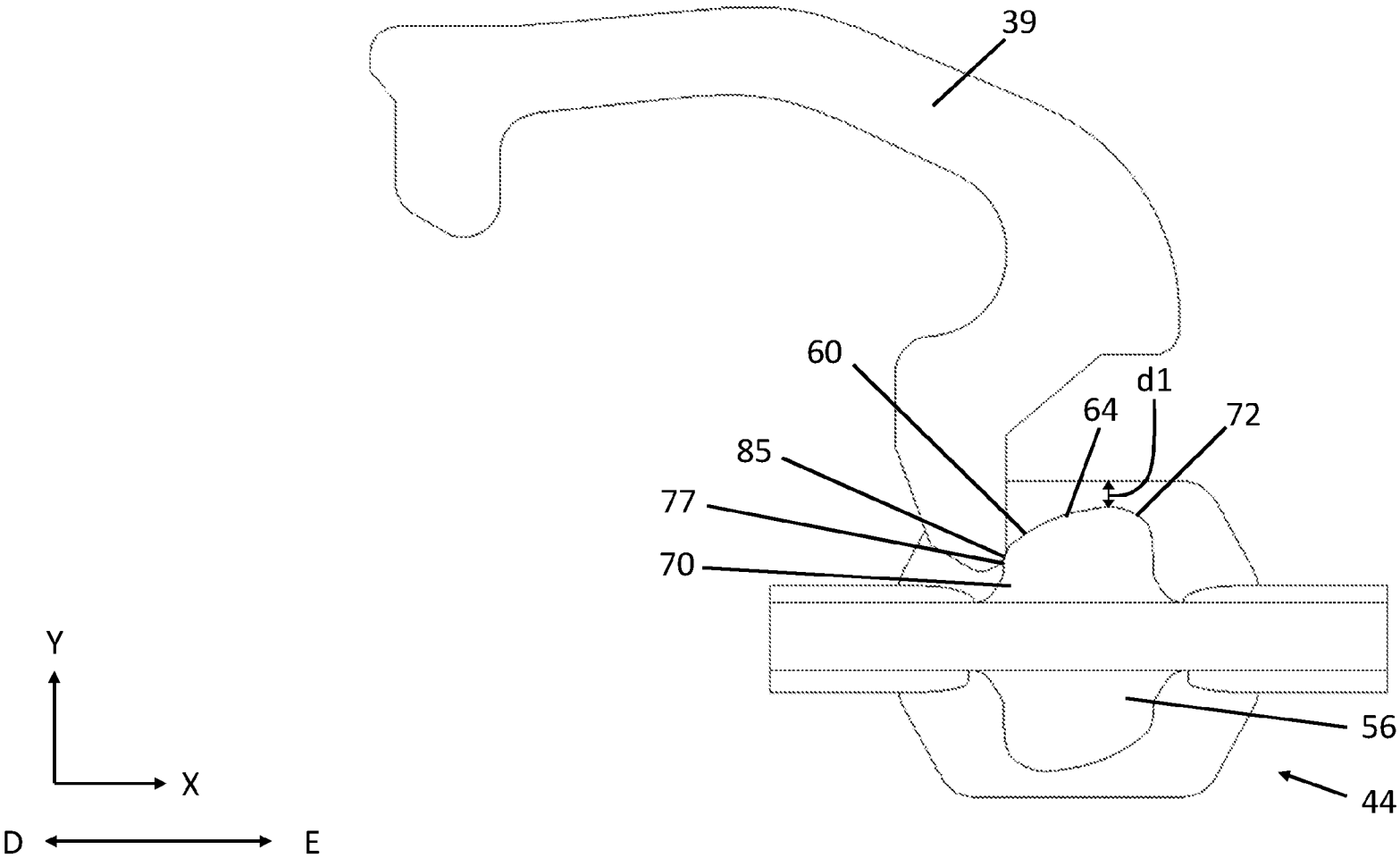

FIG. 8 shows the locking pin 39 of the slider in the first position. As can be seen, in the first position, the locking pin 39 engages the upper surface 60 of the neck 56 of the coupling element 44. In particular, the locking pin engages the second portion 70 of the neck 56, in the region of the third transition portion 85. However, in some, non-depicted, embodiments, the locking pin 39 may engage any other suitable portion of the neck 56. For example, in the first position, the locking pin 39 may engage or be engageable with the second end 77 of the neck 56. Furthermore, as discussed above, the neck 56 of the coupling element 44 is rotationally symmetric. Therefore, the coupling element 44 can be orientated in one of two possible orientations with respect to the slider and locking pin. The two possible orientations are separated from one another by 180° about the lateral axis, which extends out of the page of FIG. 8. The portion of the neck 56 that the locking pin 39 engages while the locking pin 39 is in the first position is determined by, for example, the geometry of the locking pin 39 and of the neck 56, and the orientation of the coupling element 44 with respect to the slider and locking pin 39.

While the locking pin 39 is in engagement with the neck 56 of the coupling element 44, the slider is prevented from passing in the second direction E, beyond the coupling element 44, due to the engagement between the locking pin 39 and the neck 56. However, once a force acting to move the slider in the second direction E exceeds a predetermined value, the locking pin 39 rides over the neck 56. As the locking pin 39 rides over the neck 56, the locking pin 39 may rotate about an axis that is generally parallel to the lateral axis (which extends out of the page of FIG. 8) and/or move in a direction parallel to the normal axis Y with respect to the slider 40 by virtue of the engagement between the locking pin 39 and the upper surface 60 of the neck 56. Alternatively or additionally, as the locking pin 39 rides over the neck 56, the slider body may rotate with respect to the coupling element 44 by virtue of the engagement between the locking pin 39 and the upper surface 60 of the neck 56. The force acting to move the slider in the second direction E is not necessarily directly applied to the slider. For example, a load may be applied to the two stringers of the slide fastener in opposite directions that are generally parallel to the lateral axis Z (which extends out of the page of FIG. 8). A load may be applied to the two stringers by applying a load or loads to the article to which the slide fastener is attached. The magnitude of the force that is required for the locking pin 39 to ride over the neck 56 in the second direction E is dependent upon the amount by which the locking pin 39 and second end 77 of the neck 56 overlap with one another in a direction parallel to the normal axis Y, the geometry of the locking pin 39, the geometry of the second end 77 of the neck 56, and the geometry of the third transition portion 85. Other factors can also influence the magnitude of the force that is required for the locking pin 39 to ride over the neck 56 in the second direction E, such as the direction that the force is applied to the slider. Configuring the neck 56 such that the minimum depth d1 of the first groove portion 72 of the upper groove 64 is less than the depth of the entirety of the second groove portion 74 of the upper groove 64 reduces the force that is required for the locking pin to ride over the neck 56 in the second direction E. This is as compared to if the minimum depth d1 of the first groove portion 72 of the upper groove 64 were not less than the depth of the entirety of the second groove portion. Reducing the force that is required for the locking pin 39 to ride over the neck 56 reduces, as compared to a greater force, the likelihood of one or more coupling elements being torn off the stringer by the locking pin 39. Therefore, the predetermined force is preferably less than the force required to tear a coupling element 44 off the stringer.

Figure 9:
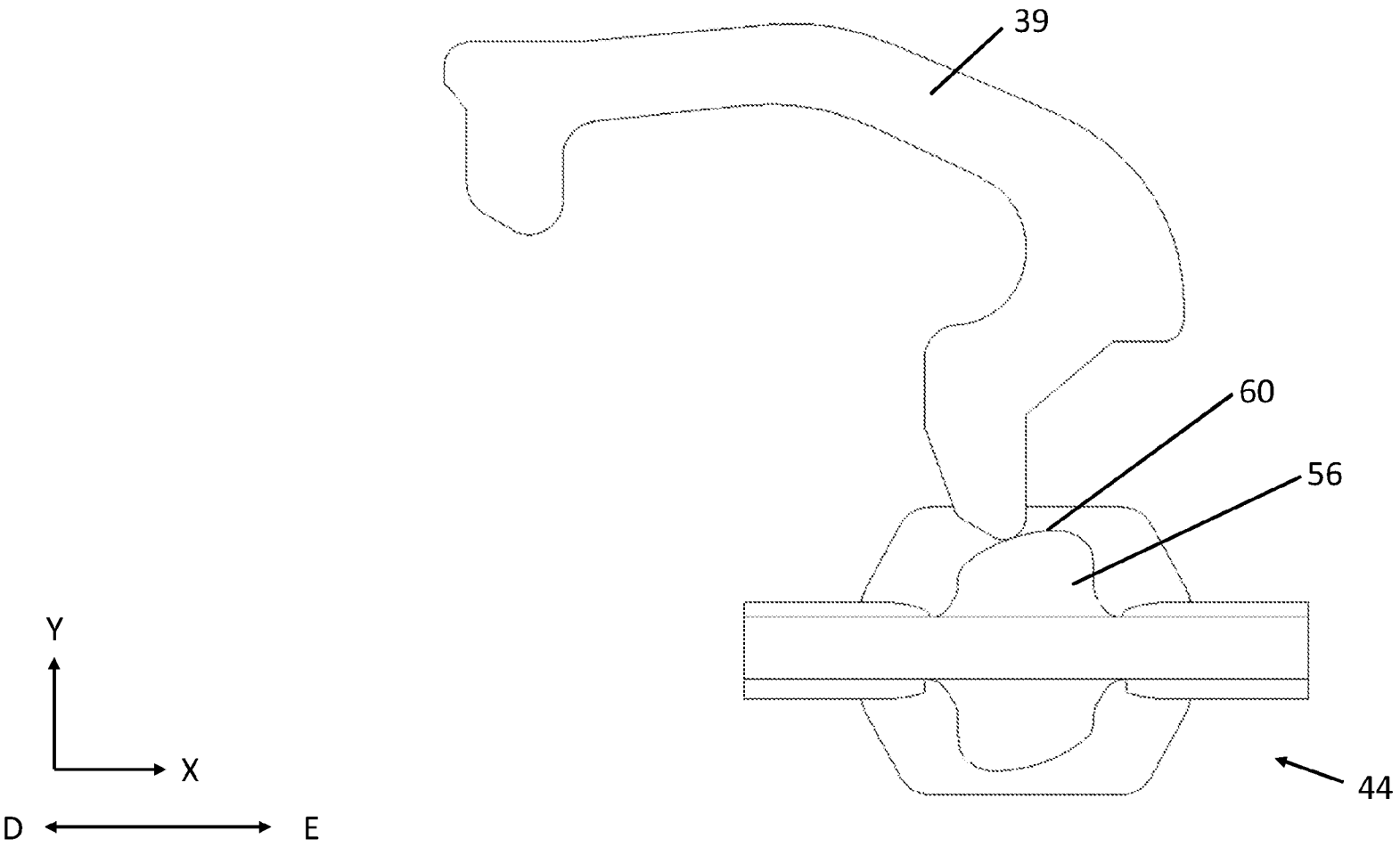

FIG. 9 shows the slider and coupling element 44 after the predetermined force has been exceeded. As can be seen, after the predetermined force has been exceeded the locking pin 39 translates in a direction parallel to the normal axis Y (and in a direction parallel to the longitudinal axis X such that the locking pin 39 engages the upper surface 60 of the neck 56. The locking pin 39 and/or the body of the slider (not depicted in FIG. 9 it has been removed for clarity) may also rotate about an axis parallel to the lateral axis (which extends out of the page of FIG. 9). With continued application of a force to move the slider in the second direction E, the locking pin 39 continues to travel along the upper surface 60 of the neck 56. However, if the force is removed, the slider may return to the position shown in FIG. 8. As the locking pin 39 continues to travel along the upper surface 60 of the neck 56, the locking pin 39 continues to translate in a direction parallel to the normal axis Y. Alternatively or additionally, the body of the slider and/or locking pin 39 may rotate about an axis parallel to the lateral axis with continues travel of the locking pin 39 along the upper surface 60 of the neck 56. In FIG. 10, the locking pin 39 has moved to be in contact with the portion of the first portion 72 of the upper groove 64 that defines the minimum depth (not labelled in FIG. 10 for clarity). Again, as the locking pin 39 travels along the upper surface 60 of the neck 56, the locking pin 39 translates in a direction parallel to the normal axis Y, and/or the locking pin 39 and/or the body of the slider rotate about an axis that is parallel to the lateral axis. In FIG. 11, the locking pin 39 has completely passed over the neck 56 of the coupling element 44.

In addition to allowing the locking pin 39 to pass over the neck 56 once the predetermined force has been exceeded, the shape of the neck 56 also improves the strength of the neck 56. The reduced areas of the neck 56 formed as a result of the geometry of the second groove portion 74 of the upper groove 64 is compensated for by the increased area of the neck 56 formed as a result of the geometry of the first groove portion 72 of the upper groove 64, and by the second groove portion 78 of the lower groove 66. In addition, the reduced area of the neck formed as a result of the geometry of the first groove portion 76 of the lower groove 66 is compensated for by the increased area of the neck 56 formed as a result of the geometry of the first groove portion 72 of the upper groove 64, and by the second groove portion 78 of the lower groove 66. This improves the strength of the neck in the lateral direction Z.

Referring back to FIG. 4. The coupling elements 36 of the first stringer 24 are orientated such that the second neck portion 70 of each of the coupling elements 36 face towards a top end 82 of the slide fastener 22 (the position of the top end 82 in FIG. 4 is merely representative since FIG. 4 shows only a portion of the slide fastener 22). The coupling elements 36 of the first stringer 24 are also orientated such that the upper groove 64 of each coupling element is disposed at a front side 84 of the slide fastener 22. Therefore, when the slider is urged in the second direction E and with the locking pin 39 of the slider 40 in the first position, the locking pin 39 engages the upper surface 60 of the neck 56 at the second end 77 of the second neck portion 70 of a coupling element of the coupling elements 36, which corresponds to the maximum depth d2. Similarly, when the slider is urged in the first direction D and with the locking pin 39 of the slider 40 in the first position, the locking pin 39 engages the upper surface of the neck at the first end 75 of the first neck portion 68 of a coupling element of the coupling elements 36, which corresponds to the minimum depth d1.

Where the coupling elements 36 of the first stringer 24 are positioned in the alternative orientation, not depicted, the coupling elements 36 are orientated such that the first neck portion 68 of each of the coupling elements 36 face towards the top end 82 of the slide fastener. In the alternative orientation, the coupling elements 36 are also orientated such that the lower groove 66 of each coupling element is disposed at the front side 84 of the slide fastener 22. Therefore, in the alternative orientation, when the slider 40 is urged in the second direction E and with the locking pin 39 of the slider 40 in the first position, the locking pin 39 engages the first end 75 of the first neck portion 68 of a coupling element of the coupling elements 36, which corresponds with the maximum depth d4. Similarly, when the slider is urged in the first direction D and with the locking pin 39 of the slider 40 in the first position, the locking pin 39 engages the second end 77 of the second neck portion 70 of a coupling element of the coupling elements 36, which corresponds to the minimum depth d3.

The coupling elements 38 of the second stringer 26 are orientated such that the first neck portion 68 of each of the coupling elements 38 face away from the top end 82 of the slide fastener 22. The coupling elements 38 of the second stringer 26 are also orientated such that the lower groove 66 of each coupling element is disposed at the front side 84 of the slide fastener 22. Therefore, with a locking pin of a second slider (not shown), where provided, in the first position and when the second slider is urged in the first direction D, the locking pin engages the lower surface 62 of the neck 56 at the first end 75 of the first neck portion 68 of a coupling element of the coupling elements 38, which corresponds with the maximum depth d4. Similarly, with the locking pin of the second slider in the first position and when the second slider is urged in the second direction E, the locking pin engages the lower surface 62 of the neck 56 at the second end 77 of the second neck portion 70 of a coupling element of the coupling elements 38, which corresponds with the minimum depth d3.

Where the coupling elements 38 of the second stringer 26 are positioned in the alternative orientation, not depicted, the coupling elements 38 are orientated such that the second neck portion 70 of each of the coupling elements 38 face away from the top end 82 of the slide fastener. In the alternative orientation, the coupling elements 38 are also orientated such that the upper groove 64 of each coupling element is disposed at the front side 84 of the slide fastener 22. Therefore, in the alternative orientation, with the locking pin 39 of the slider 40 in the first position and when the second slider is urged in the second direction E, the locking pin 39 engages the upper surface 60 of the neck 56 at the second end 77 of the second neck portion 70 of a coupling element of the coupling elements 38, which corresponds to the minimum depth d1. Similarly, with the locking pin of the second slider in the first position and when the slider is urged in the first direction D, the locking pin engages the upper surface of the neck at the first end 75 of the first neck portion 68 of a coupling element of the coupling elements 38, which corresponds to the maximum depth d2.

From the above, it can be said that the coupling elements 36', 38' of each of the stringers are orientated such that the locking pin of a slider being moved, or urged, in a direction to decouple the coupling elements engages the end of the neck portion that defines the maximum depth. In addition, when the slider being moved, or urged, in a direction to couple the coupling elements, the locking pin engages the end of the neck portion that defines the minimum depth.

In some embodiments, with the locking pin 39 of the slider 40 in the first position, the locking pin 39 may engage a coupling element 38 of the second stringer 26. In some embodiments, with the locking pin of the second slider in the first position, the locking pin may engage a coupling element 36 of the first stringer 24.

Since the coupling elements 36, 38 can be affixed to their respective fastener tape 28, 30 in one of two possible orientations, the above description applies mutatis mutandis to where the coupling elements 36 of the first stringer 24 and/or the coupling elements 38 of the second stringer 36 are disposed in the alternative orientation.

As discussed above, in some embodiments, the upper groove and the lower groove may be provided to the main body of the coupling element. FIGS. 12 to 18 show an embodiment of such a coupling element 44'. The features of the coupling element 44' are generally the same as the features of the coupling element 44 of the previous embodiment, with the exception of the position of the upper groove 64' and of the lower groove 66'. Therefore, like numerals to those used in the previous figures will be used throughout the description of FIGS. 12 to 18, where appropriate, to refer to equivalent features.

Figure 12:
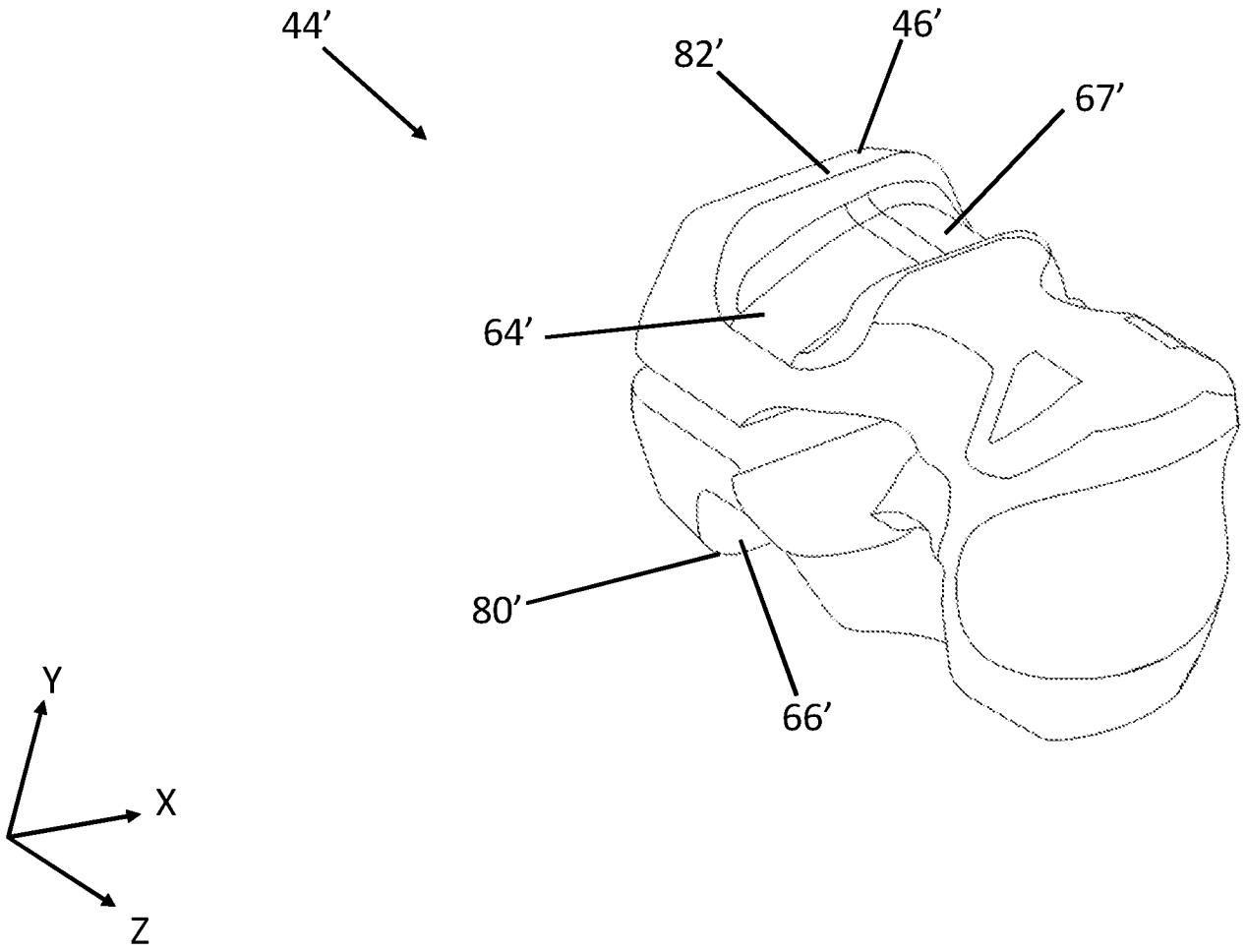
FIG. 12 shows a perspective view of a coupling element according to an embodiment of the present invention.

Referring first to FIG. 12. The main body 46' includes a grooved portion 67'. The grooved portion 67' comprises an upper groove 64' and a lower groove 66'. The upper groove 64' extends parallel to the longitudinal axis X. The upper groove 64' extends along the upper surface 82' of the main body 46'. The lower groove 66' extends parallel to the longitudinal axis X. The lower groove 66' extends along the lower surface 80' of the main body 46'. As for the neck of the previous embodiment, the main body 46', in particular the upper groove 64' and the lower groove 66' of the main body, is designed such that the locking pin of the slider passes over the main body 46' once a force acting to move the slider in the second direction (i.e., the direction in which the slider decouples the coupling elements) exceeds a predetermined value. In some embodiments, the predetermined value may be at least 35N and/or up to 75N. In some embodiments, the predetermined value may be at least 20N and/or up to 150N. The magnitude of the predetermined value is a function of, among other things, the size of the slide fastener on to which the coupling element 44' is mounted, which includes the size of the coupling element 44', and the type of slide fastener on to which the coupling element 44' is mounted.

Figure 13:
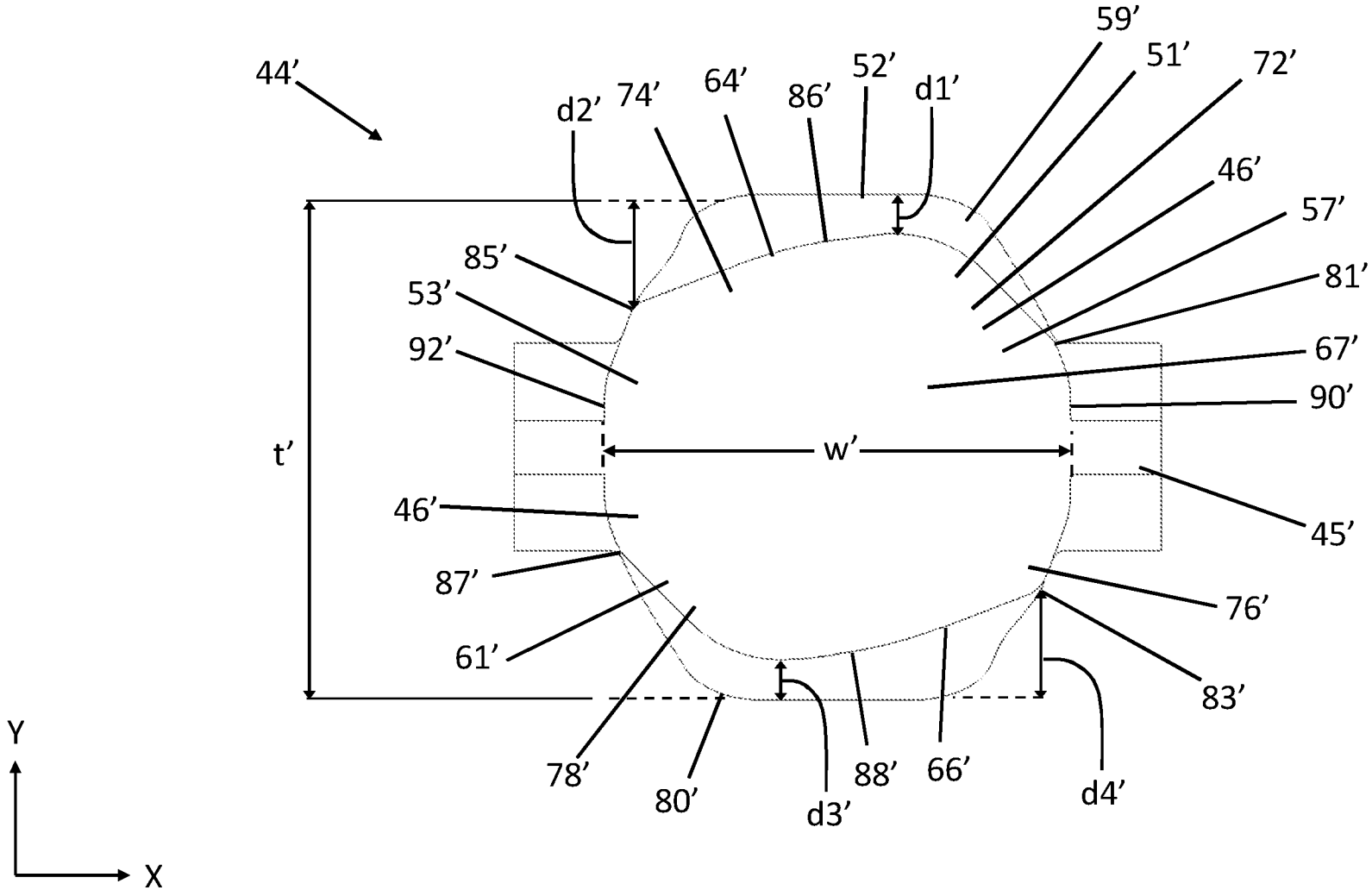
FIG. 13 shows a cross-sectional view of the coupling element of FIG. 12.

FIG. 13 shows a cross-sectional view of the coupling element 44' in a plane perpendicular to the lateral axis (which extends out of the page of FIG. 13). FIG. 13 shows the coupling element 44' mounted on to a fastener tape 45'. The cross-section for the view of FIG. 13 has been taken through the main body 46' of the coupling element 44'. The plane of the cross-sectional view extends through a middle region, in the direction of the lateral axis Z, of the main body 46'. As can be seen, the middle region of the main body 46' is generally parallelogram-shaped in a cross-sectional plane that is perpendicular to the lateral axis.

The grooved portion 67' comprises an upper surface 86' and a lower surface 88'. The upper surface 86' and the lower surface 88' are convex or at least partly convex. The grooved portion 67' of the main body 46' comprises a first portion 51'. The first portion 51' of the grooved portion 67' forms a part of the first portion 59' of the proximal portion 57'. The grooved portion 67' of the main body 46' comprises a second portion 53'. The second portion 53' of the grooved portion 67' forms a part of the second portion 61' of the proximal portion 57'. The second portion 53' of the grooved portion 67' is disposed along the longitudinal axis X, adjacent to the first portion 51' of the grooved portion. In some embodiments, the first portion 51' and the second portion 53' may each comprise 50% of the grooved portion 67'. The first portion 51' and the second portion 53' may each comprise 50% of the volume of the grooved portion 67'. The first portion 51' and the second portion 53' may each comprise 50% of the length of the grooved portion 67' in a direction parallel to the longitudinal axis X. In particular, a plane at the interface between the first portion 51' and the second portion 53' may extend parallel to the lateral axis Z and be disposed at a midpoint of the grooved portion 67' in a direction parallel to the longitudinal axis X.

The first portion 51' of the grooved portion 67' defines a first end 90' in a direction parallel to the longitudinal axis X. The first end 90' may be an end region, or end-point. The first end 90' is an end region or end-point of the grooved portion 67'. The first end 90' is defined between a first point and a second point. The first point is disposed at the location at which, when starting from a midpoint along the longitudinal axis X of the upper surface 86' of the grooved portion 67' and moving in a direction parallel to the longitudinal axis X and away from the second portion 53' of the grooved portion 67', an angle between a normal extending from the upper surface 86' of the grooved portion 67' and the longitudinal axis X is less than 25 degrees. The second point is disposed at the location at which, when starting from a midpoint along the longitudinal axis X of the lower surface 88' of the grooved portion 67' and moving in a direction parallel to the longitudinal axis X and away from the second portion 53' of the grooved portion 53', an angle between a normal extending from the lower surface 88' of the grooved portion 67' and the longitudinal axis X is less than 25 degrees. Here, the angle between the normal extending from the upper surface 86' or the lower surface 88' of the grooved portion 67' and the longitudinal axis X refers to the acute angle, and not obtuse angle, that is formed between the normal and the longitudinal axis.

The upper surface 86' of the grooved portion 67' merges into the first end 90' of the first portion 51' of the grooved portion 67' via a first transition portion 81'. The first transition portion 81' is radiused. However, in other, non-depicted, embodiments, the first transition portion 81' may be of any suitable geometry. For example, the first transition portion 81' may define a vertex or chamfer. The lower surface 88' of the grooved portion 67' merges into the first end 90' via a second transition portion 83'. The second transition portion 83' is radiused. However, in other, non-depicted, embodiments, the second transition portion 83' may be of any suitable geometry. For example, the second transition portion 83' may define a vertex or chamfer.

The second grooved portion 53' defines a second end 92' in a direction parallel to the longitudinal axis X. The second end 92' may be an end region or an end-point. The second end 92' is an end region or end-point of the grooved portion 67'. The second end 92' is defined between a first point and a second point. The first point is disposed at the location at which, when starting from a midpoint along the longitudinal axis X of the upper surface 86' of the grooved portion 67' and moving in a direction parallel to the longitudinal axis X and away from the first portion 51' of the grooved portion 67', an angle between a normal extending from the upper surface 86' of the grooved portion 67' and the longitudinal axis X is less than 25 degrees. The second point is disposed at the location at which, when starting from a midpoint along the longitudinal axis X of the lower surface 88' of the grooved portion 67' and moving in a direction parallel to the longitudinal axis X and away from the first portion 51' of the grooved portion 67', an angle between a normal extending from the lower surface 88' of the grooved portion 67' and the longitudinal axis X is less than 25 degrees. Here, the angle between the normal extending from the upper surface 86' or lower surface 88' of the grooved portion 67' and the longitudinal axis X refers to the acute angle, and not obtuse angle, that is formed.

The upper surface 86' of the grooved portion 67' merges into the second end 92' via a third transition portion 85'. The third transition portion 85' is radiused. However, in other, non-depicted, embodiments, the third transition portion 85' may be of any suitable geometry. For example, the third transition portion 85' may define a vertex or chamfer. The lower surface 88' of the grooved portion 67' merges into the second end 92' via a fourth transition portion 87'. The fourth transition portion 87' is radiused. However, in other, non-depicted, embodiments, the fourth transition portion 87' may be of any suitable geometry. For example, the fourth transition portion 87' may define a vertex or chamfer.

The main body 46' defines a width w'. The width w' of the main body 46' extends from a first extremity of the main body 46' in the direction of the longitudinal axis X to a second extremity of the main body 46' in the direction of the longitudinal axis X. The width w' is measured in a direction parallel to the longitudinal axis X.

The upper groove 64' comprises a first groove portion 72' in the region of the first portion 59' of the proximal portion 57'. The upper groove 64' comprises a second groove portion 74' in the region of the second portion 61' of the proximal portion 57'. A depth of any point of the first groove portion 72' or of the second groove portion 74' may be understood to refer to a distance in a direction parallel to the normal axis Y, perpendicular to both the longitudinal axis X and to the lateral axis, from the upper surface 52' of the main body 46' of the coupling element 44' to the upper surface 86' of the grooved portion 67'. The first groove portion 72' defines a minimum depth d1'. The minimum depth d1' of the first groove portion 72' is a minimum depth of the upper groove 64'. The minimum depth d1' of the first groove portion 72' is less than the depth of the entirety of the second groove portion 74' of the upper groove 64'. In some embodiments, the minimum depth d1' may be zero. The predetermined force for a locking pin of a slider to pass over the grooved portion 67' of the body 46' is a function of the minimum depth d1'.

The second groove portion 74' of the upper groove 64' defines a maximum depth d2'. The maximum depth d2' of the second groove portion 74' is a maximum depth of the upper groove 64'. The maximum depth d2' of the second groove portion 74' is greater than the depth of the entirety of the first groove portion 72' of the upper groove 64'. However, in some embodiments, the maximum depth d2' of the second groove portion 74' may be equal to the depth of at least part of the first groove portion 72' of the upper groove 64'. However, where the maximum depth d2' of the second groove portion 74' of the upper groove 64' is equal to the depth of at least part of the first groove portion 72' of the upper groove 64', the depth of at least part of the first groove portion 72' may be less than the depth of at least part of the second groove portion 74'. The predetermined force for a locking pin of a slider to pass over the grooved portion is a function of the maximum depth d2'. In particular, the greater the magnitude of the maximum depth d2', the smaller the magnitude of the predetermined force required for a locking pin of a slider to pass over the upper surface 86' of the grooved portion 67' of the main body 46'. Similarly, the smaller the magnitude of the maximum depth d2', the greater the magnitude of the predetermined force required for a locking pin of a slider to pass over the upper surface 86' of the grooved portion 67' of the main body 46'.

The maximum depth d2' of the second groove portion 74' of the upper groove 64' is at least 15% greater than the minimum depth d1' of the first groove portion 72' of the upper groove 64'. Thus, a minimum depth differential between the minimum depth d1' of the first groove portion 72' of the upper groove 64' and the maximum depth d2' of the second groove portion 74' of the upper groove 64' is provided. The force required for a locking pin of a slider to pass over the upper groove 64' is a function of the minimum depth d1', the maximum depth d2', and the difference between the minimum depth d1' and the maximum depth d2'. The force required for a locking pin of a slider to pass over the upper groove 64' increases with an increasing difference between the minimum depth d1' and the maximum depth d2'. However, other factors, such as the geometry of the locking pin, may influence the force required for a locking pin of a slider to pass over the upper groove 64'. The maximum depth d2' being at least 15% greater than the minimum depth d1' advantageously facilitates passage of a locking pin of a slider over the upper groove 64'. However, in some embodiments, the maximum depth d2' of the second groove portion 74' of the upper groove 64' may be less than 15% greater than the minimum depth d1' of the first groove portion 72' of the upper groove 64'.

The maximum depth d2' of the second groove portion 74' of the upper groove 64' is up to seven times greater than the minimum depth d1' of the first groove portion 72' of the upper groove 64'. As discussed above, the force required for a locking pin of a slider to pass over the upper groove 64' is a function of the difference between the minimum depth d1' and the maximum depth d2'. Where the maximum depth d2' is more than seven times greater than the minimum depth d1', the likelihood of the locking pin of a slider unintentionally passing over the upper groove 64' exceeds an acceptable value. However, in some embodiments, the maximum depth d2' of the second groove portion 74' of the upper groove 64' may be more than seven times greater than the minimum depth d1' of the first groove portion 72' of the upper groove 64'.

The position of the minimum depth d1' of the first groove portion 72' of the upper groove 64' is offset from the first end 90' of the first portion 51' of the grooved portion 67'. The position of the minimum depth d1' of the first groove portion 72' of the upper groove 64' is offset from the first end 90' of the first portion 51' of the grooved portion 67' in a direction parallel to the longitudinal axis X. The distance by which the position of the minimum depth d1' is offset from the first end 90' of the first portion 51' of the grooved portion 67' is at least 20% of the width w' of the body 46'. The distance by which the position of the minimum depth d1' is offset from the first end 90' of the first portion 51' of the grooved portion 67' is up to 50% of the width w' of the body 46'. In some embodiments, the position of the minimum depth d1' may not be offset from the first end 90' of the first portion 51' of the grooved portion 67'.

The body 46' defines a thickness t'. The thickness t' of the body 46' is measured from the upper surface 52' of the body 46' to the lower surface 80' of the body 46'. The thickness t' of the body 46' is measured in a direction parallel to the normal axis Y. The maximum depth d2' of the second groove portion 74'of the upper groove 64' is at least 5% of the thickness t' of the body 46'. The maximum depth d2' of the second groove portion 74' of the upper groove 64' is up to 30% of the thickness t' of the body 46'. The maximum depth d2' of the second groove portion 74' being up to 30% of the thickness t' of the body 46' advantageously provides the body 46' with additional strength, as compared to where the maximum depth d2' of the second groove portion 74' is more than 30% of the thickness t' of the body 46'. In addition, the maximum depth d2' being up to 30% of the thickness t' of the body 46' advantageously reduces the likelihood of a locking pin of a slider inadvertently passing over the grooved portion 67'. The maximum depth d2' being at least 5% of the thickness t' of the body 46' advantageously reduces the likelihood of the coupling element 44' being removed from the fastener tape by a load exerted on the coupling element 44' by a locking pin of a slider. In some embodiments, the maximum depth d2' of the second groove portion 74' of the upper groove 64' may be less than 5%, or more than 30%, of the thickness t' of the body 46'.

The lower groove 66' comprises a first groove portion 76' in the region of the first portion 59' of the proximal portion 57'. The lower groove 64' comprises a second groove portion 78' in the region of the second portion 61' of the proximal portion 57'. A depth of any point of the first groove portion 76' or of the second groove portion 78' may be understood to refer to a distance in a direction parallel to the normal axis Y from the lower surface 80' of the body 46' of the coupling element 44' to the lower surface 88' of the grooved portion 67'. The second groove portion 78' defines a minimum depth d3'. The minimum depth d3' of the second groove portion 78' is a minimum depth of the lower groove 66'. The minimum depth d3' of the second groove portion 78' is less than the depth of the entirety of the first groove portion 76' of the lower groove 66'. The predetermined force for a locking pin of a slider to pass over the lower surface 66' of the grooved portion 67' of the body 46' is a function of the minimum depth d3'.

The minimum depth d3' of the second groove portion 78' of the lower groove 66' being less than the depth of the entirety of the first groove portion 76' of the lower groove 66' advantageously results in the shape of the grooved portion 67' and of the body 46' being more uniform. To affix a coupling element 44' to a fastener tape, the coupling element 44' is injection moulded on to a moving fastener tape. While affixing the coupling element 44' to a fastener tape, the head 54' and neck 56' of the coupling element are urged in a direction opposite to the direction of motion of the fastener tape. This can result in deformation of the body 46', in particular in the region of the grooved portion 67'. Where the second portion 53' of the grooved portion 67' trails the first portion 51' of the grooved portion 67', the minimum depth d3' of the second groove portion 78' provides the body 46' with additional strength to resist deformation in a direction that is opposite to the direction of motion of the fastener tape. This results in a more uniformly shaped body 46'.

The first groove portion 76' of the lower groove 66' defines a maximum depth d4'. The maximum depth d4' of the first groove portion 76' is a maximum depth of the lower groove 66'. The maximum depth d4' of the first groove portion 76' is greater than the depth of the entirety of the second groove portion 78' of the lower groove 66'. However, in some embodiments, the maximum depth d4' of the first groove portion 76' may be equal to the depth of at least part of the second groove portion 78' of the lower groove 66'. However, where the maximum depth d4' of the first groove portion 76' of the lower groove 66' is equal to the depth of at least part of the second groove portion 78' of the lower groove 66', the depth of at least part of the second groove portion 78' may be less than the depth of at least part of the first groove portion 76' of the lower groove 66'. The predetermined force for a locking pin of a slider to pass over the lower surface 88' of the grooved portion 67' of the body 46' is a function of the maximum depth d4'. In particular, the greater the magnitude of the maximum depth d4', the smaller the magnitude of the predetermined force required for a locking pin of a slider to pass over the lower surface 88' of the grooved portion 67', and the smaller the magnitude of the maximum depth d4', the greater the magnitude of the predetermined force required for a locking pin of a slider to pass over the lower surface 88' of the grooved portion 67'.

The maximum depth d4' of the first groove portion 76' of the lower groove 66' is at least 15% greater than the minimum depth d3' of the second groove portion 78' of the lower groove 66'. Thus, a minimum depth differential between the minimum depth d3' of the second groove portion 78' of the lower groove 66' and the maximum depth d4' of the first groove portion 76' of the lower groove 66' is provided. The force required for a locking pin of a slider to pass over the lower groove 66' is a function of the minimum depth d3', the maximum depth d4', and the difference between the minimum depth d3' and the maximum depth d4'. The force required for a locking pin of a slider to pass over the lower groove 66' increases with an increasing difference between the minimum depth d3' and the maximum depth d4'. However, other factors, such as the geometry of the locking pin, influence the force required for a locking pin of a slider to pass over the lower groove 66'. The maximum depth d4' being at least 15% greater than the minimum depth d3' advantageously facilitates passage of a locking pin of a slider over the lower surface 88' of the grooved portion 67'. It is desirable for this advantage to be provided by the lower groove 66' because the coupling element 44' can be mounted on to a fastener tape in one of two possible orientations, as will be discussed below. However, in some embodiments, the maximum depth d4' of the first groove portion 76' of the lower groove 66' may be less than 15% greater than the minimum depth d3' of the second groove portion 76' of the lower groove 66'.

The maximum depth d4' of the first groove portion 76' of the lower groove 66' is up to seven times greater than the minimum depth d3' of the second groove portion 78' of the lower groove 66'. As discussed above, the force required for a locking pin of a slider to pass over the lower groove 66' is a function of the difference between the minimum depth d3' and the maximum depth d4'. Where the maximum depth d4' is more than seven times greater than the minimum depth d3', the likelihood of the locking pin of a slider unintentionally passing over the lower groove 66' exceeds an acceptable value.

However, in some embodiments, the maximum depth d4' of the first groove portion 76' of the lower groove 66' may be more than seven times greater than the minimum depth d3' of the second groove portion 78' of the lower groove 66'.

The maximum depth d4' of the first groove portion 76' of the lower groove 66' is at least 5% of the thickness t' of the body 46'. The maximum depth d4' of the first groove portion 76' of the lower groove 66' is up to 30% of the thickness t' of the body 46'. The maximum depth d4' of the second groove portion 74' being up to 30% of the thickness t' of the body 46' advantageously provides the body 46' with additional strength, as compared to where the maximum depth d4' of the first groove portion 76' is more than 30% of the thickness t' of the body 46. In addition, the maximum depth d4' being up to 30% of the thickness t' of the body 46' advantageously reduces the likelihood of a locking pin of a slider inadvertently passing over the grooved portion 67'. The maximum depth d4' being at least 5% of the thickness t' of the body 46' advantageously reduces the likelihood of the coupling element 44' being removed from the fastener tape by a load exerted on the coupling element by a locking pin of a slider. However, in some embodiments, the maximum depth d4' of the first groove portion 76' of the lower groove 66' may be less than 5%, or more than 30%, of the thickness t' of the body 46'.

The position of the minimum depth d3' of the second groove portion 78' of the lower groove 66' is offset from the second end 92' of the grooved portion 67'. The position of the minimum depth d3' of the second groove portion 78' of the lower groove 66' is offset from the second end 92' of the grooved portion 67' in a direction parallel to the longitudinal axis X. The distance by which the position of the minimum depth d3' is offset from the second end 92' of the grooved portion 67' is at least 20% of the width w' of the body 46'. The distance by which the position of the minimum depth d3' is offset from the second end 92' of the grooved portion 67' is up to 50% of the width w' of the body 46'. In some embodiments, the position of the minimum depth d3' may not be offset from the second end 92' of the grooved portion 67'.

The minimum depth d1' of the first groove portion 72' of the upper groove 64' is less than the depth of the entirety of the first groove portion 76' of the lower groove 66'. This can be the case both where the grooved portion 67' is not rotationally symmetric, and where the grooved portion 67' is rotationally symmetric. The minimum depth d3' of the second groove portion 78' of the lower groove 66' is less than the depth of the entirety of the second groove portion 74' of the upper groove 64'. This can be the case both where the grooved portion 67' is not rotationally symmetric, and where the grooved portion 67' is rotationally symmetric.

Conventionally, to affix coupling elements to a fastener tape, the coupling elements are injection moulded on to a fastener tape. Once two fastener tapes have been provided with adequate coupling elements, the coupling elements are interdigitated. If the coupling elements have not cooled sufficiently upon interdigitation, the coupling elements can deform. The minimum depth d1' of the first groove portion 72' of the upper groove 64' being less than the depth of the entirety of the first groove portion 76' of the lower groove 66', and the minimum depth d3' of the second groove portion 76' of the lower groove 64' being less than the depth of the entirety of the second groove portion 74' of the upper groove 64', advantageously reduces or eliminates such deformation. This is because the reduced areas of the grooved portion 67' formed as a result of the geometry of the second groove portion 74' of the upper groove 64', and the first groove portion 76' of the lower groove 66' are compensated for by the increased area of the grooved portion 67' formed as a result of the geometry of the first groove portion 72' of the upper groove 64', and the second groove portion 78' of the lower groove 66'. This provides the grooved portion 67' of the coupling element 44' with the strength to withstand being coupled with one or more coupling elements without, or with significantly reduced, deformation.

As can be seen from the cross-sectional view of FIG. 13, the grooved portion 67' is rotationally symmetric when viewed in a cross-sectional plane that is perpendicular to the lateral axis Z (as is the case for the cross-sectional view of FIG. 13). The grooved portion 67' is rotationally symmetric along at least 25% of the length of the grooved portion 67'. The length of the grooved portion 67' extends in a direction parallel to the lateral axis Z, which extends out of the page of FIG. 13. In some, non-depicted, embodiments, the grooved portion 67' may be rotationally symmetric in at least one cross-sectional plane that is perpendicular to the lateral axis. In the depicted embodiment, the rotational symmetry of the grooved portion 67' has an order of two. However, in some, non-depicted embodiments, the order of rotational symmetry of the grooved portion 67' may be more than two. Advantageously, the grooved portion 67' being rotationally symmetric allows the stringer on to which the coupling element 44' is mounted to be affixed to an article in the two possible orientations without impacting the performance of the stringer, as will be discussed in more detail below.

Figure 14:
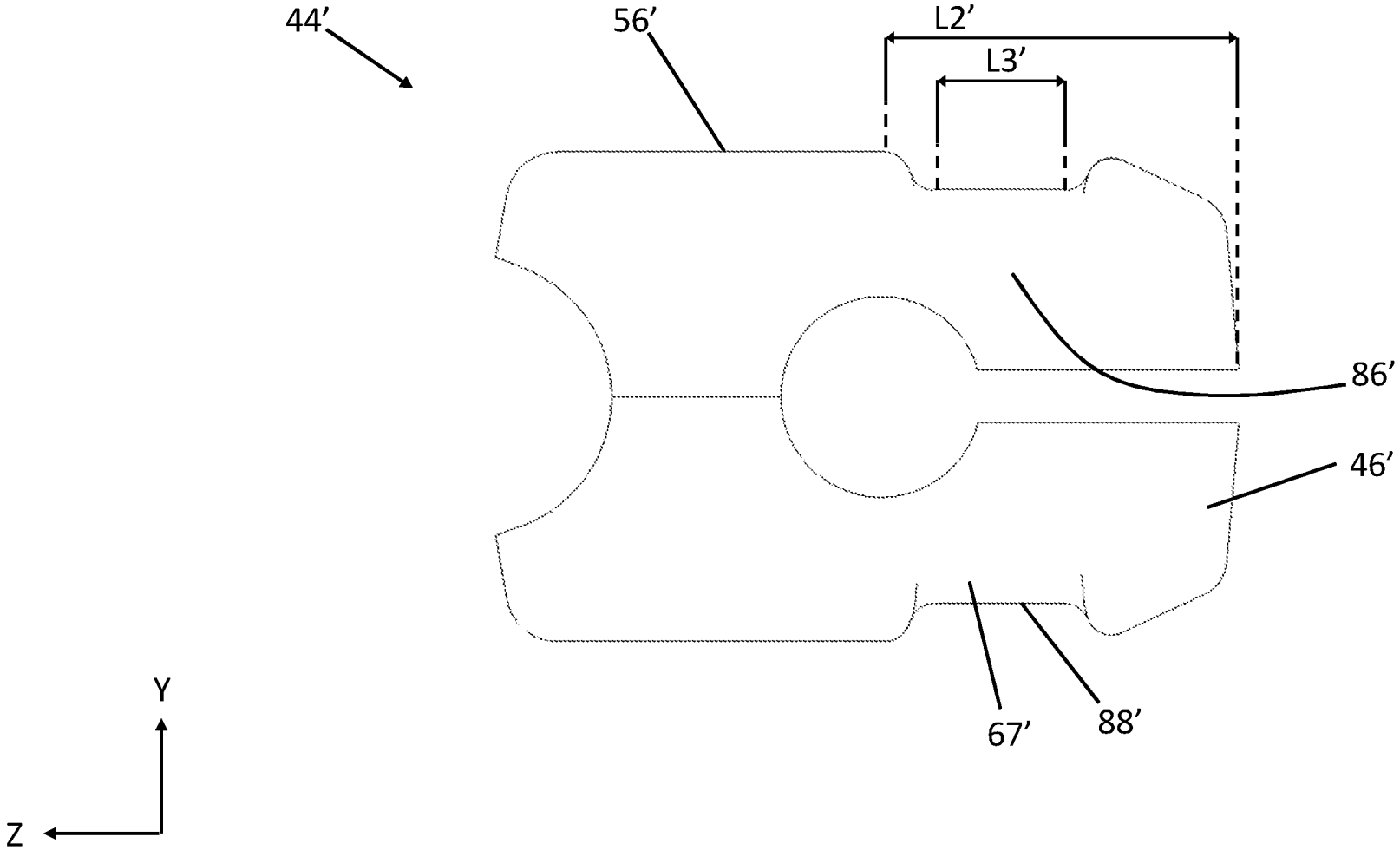
FIG. 14 shows a side view of the coupling element of FIG. 12.

Referring now to FIG. 14. The grooved portion 67' of the coupling element 44 defines a length L3'. The length L3' of the grooved portion 67' extends parallel to the lateral axis Z. The length L3' of the grooved portion 67' is measured along the portion of the grooved portion 67' that is parallel to the lateral axis Z. In embodiments where no portion of the grooved portion 67' is parallel to the lateral axis Z, the length L3' of the grooved portion 67' is measured along the thinnest portion of the grooved portion 67' in a direction parallel to the lateral axis Z. The thinnest portion of the grooved portion 67' is the portion having the smallest distance from the upper surface 86' of the grooved portion 67' to the lower surface 88' of the grooved portion 67' in a direction parallel to the normal axis Y. The body 46' defines a length L2'. The length of the body 46' extends parallel to the lateral axis Z. The body 46' adjoins the neck 56'. Therefore, the length of the body 46' is measured from the point at which the body 46' and neck 56' interface one another to a rearmost point of the body 46'. The rearmost point of the body 46' refers to the point of the body 46' that is disposed furthest away from the neck 56' in a direction that is parallel to the lateral axis Z. The length L3' of the grooved portion 67' is up to 65% of the length L2' of the body 46'. This advantageously reduces the likelihood of the body 46' cracking in use. In some embodiments, the length L3' of the grooved portion 67' may be at least 5% of the length L2' of the body 46'. In some embodiments, the length L3' of the grooved portion 67' may less than 5% or more than 65% of the length L2' of the body 46'.

Figure 15:
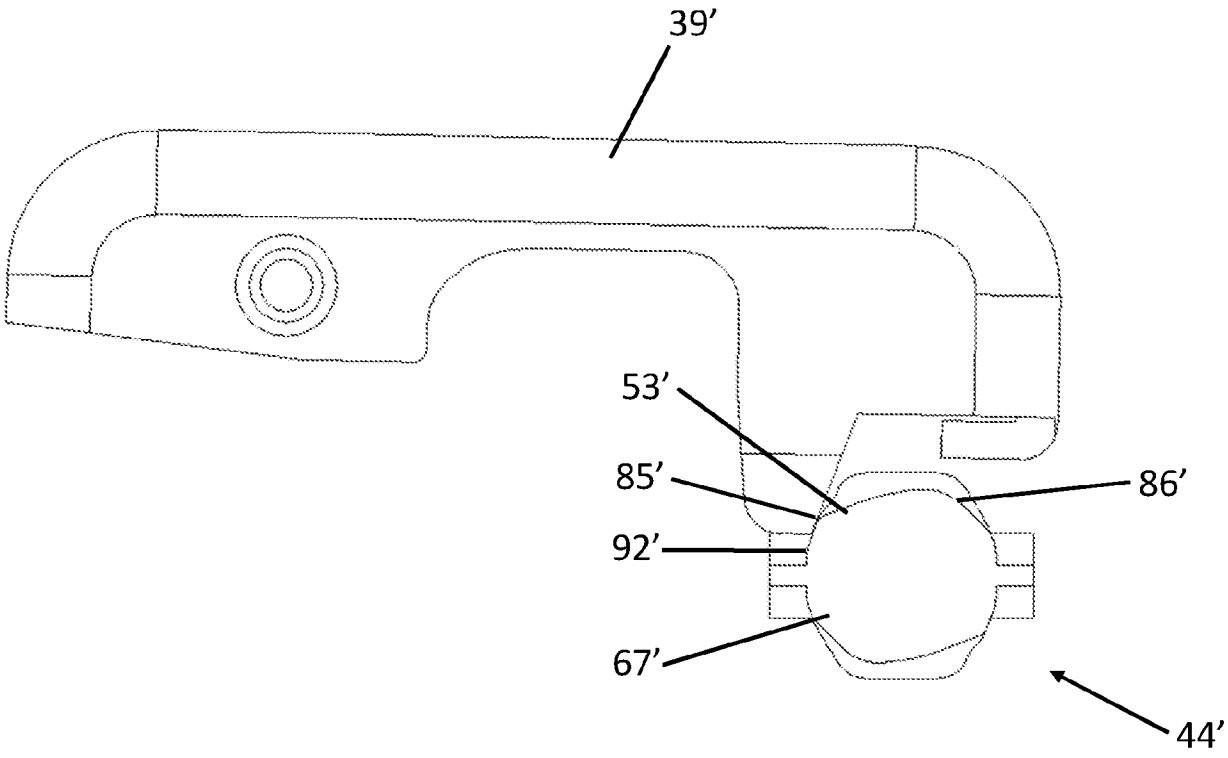
Figure 15:
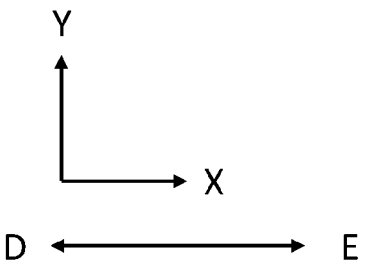

FIG. 15 shows the locking pin 39' of the slider (not shown in FIG. 15—it has been removed for clarity) in the first position. As can be seen, in the first position, the locking pin 39' engages the upper surface 86' of the grooved portion 67'. In particular, the locking pin 39' engages the second portion 53' of the grooved portion 67', in the region of the third transition portion 85'. However, in some, non-depicted, embodiments, the locking pin 39' may engage any other suitable portion of the grooved portion 67'. For example, in the first position, the locking pin 39' may engage or be engageable with the second end 92' of the grooved portion 67'. The locking pin 39' may engage or be engageable with the second end 92' of the grooved portion 67' and the second portion 53' of the grooved portion 67' in the region of the third transition portion 85'. Furthermore, as discussed above, the grooved portion 67' is rotationally symmetric. Therefore, the coupling element 44' can be orientated in one of two possible orientations with respect to the slider and locking pin 39'. The two possible orientations are separated from one another by 180° about the lateral axis, which extends out of the page of FIG. 15. The portion of the grooved portion 67' that the locking pin 39' engages while the locking pin 39' is in the first position is determined by, for example, the geometry of the locking pin 39' and of the grooved portion 67', and the orientation of the coupling element 44' with respect to the slider and locking pin 39'.

While the locking pin 39' is in engagement with the grooved portion 67' of the coupling element 44', the slider is prevented from passing in the second direction E, beyond the coupling element 44', due to the engagement between the locking pin 39' and the grooved portion 67'. However, once a force acting to move the slider in the second direction E exceeds a predetermined value, the locking pin 39' rides over the grooved portion 67'. As the locking pin 39' rides over the grooved portion 67', the locking pin 39' may rotate about an axis that is generally parallel to the lateral axis (which extends out of the page of FIG. 15) and/or move in a direction parallel to the normal axis Y with respect to the slider by virtue of the engagement between the locking pin 39' and the upper surface 86' of the grooved portion 67'. Alternatively or additionally, as the locking pin 39' rides over the grooved portion 67', the slider body may rotate with respect to the coupling element 44' by virtue of the engagement between the locking pin 39' and the upper surface 86' of the grooved portion 67'. The force acting to move the slider in the second direction E is not necessarily directly applied to the slider. For example, a load may be applied to the two stringers of the slide fastener in opposite directions that are generally parallel to the lateral axis Z (which extends out of the page of FIG. 15). A load may be applied to the two stringers by applying a load or loads to the article to which the slide fastener is attached. The magnitude of the force that is required for the locking pin 39' to ride over the grooved portion 67' in the second direction E is a function of the amount by which the locking pin 39' and second end 92' of the grooved portion 67' overlap with one another in a direction parallel to the normal axis Y, the geometry of the locking pin 39', the geometry of the second end 92' of the grooved portion 67', the maximum depth d2' (not labelled in FIG. 15 for clarity), the minimum depth d1' (not labelled in FIG. 15 for clarity), the difference between the maximum depth d2' and the minimum depth d1', and the geometry of the third transition portion 85'. Other factors can also influence the magnitude of the force that is required for the locking pin 39' to ride over the grooved portion 67' in the second direction E, such as the direction that the force is applied to the slider. Configuring the grooved portion 67' such that the minimum depth d1' of the first groove portion 72' of the upper groove 64' is less than the depth of the entirety of the second groove portion 74' of the upper groove 64' reduces the force that is required for the locking pin to ride over the grooved portion 67' in the second direction E. This is as compared to if the minimum depth d1' of the first groove portion 72' of the upper groove 64' were not less than the depth of the entirety of the second groove portion 74'. Reducing the force that is required for the locking pin 39' to ride over the grooved portion 67' reduces, as compared to a greater force, the likelihood of one or more coupling elements being torn off the stringer by the locking pin 39'. Therefore, the predetermined force is preferably less than the force required to tear a coupling element 44' off the stringer.

Figure 18:
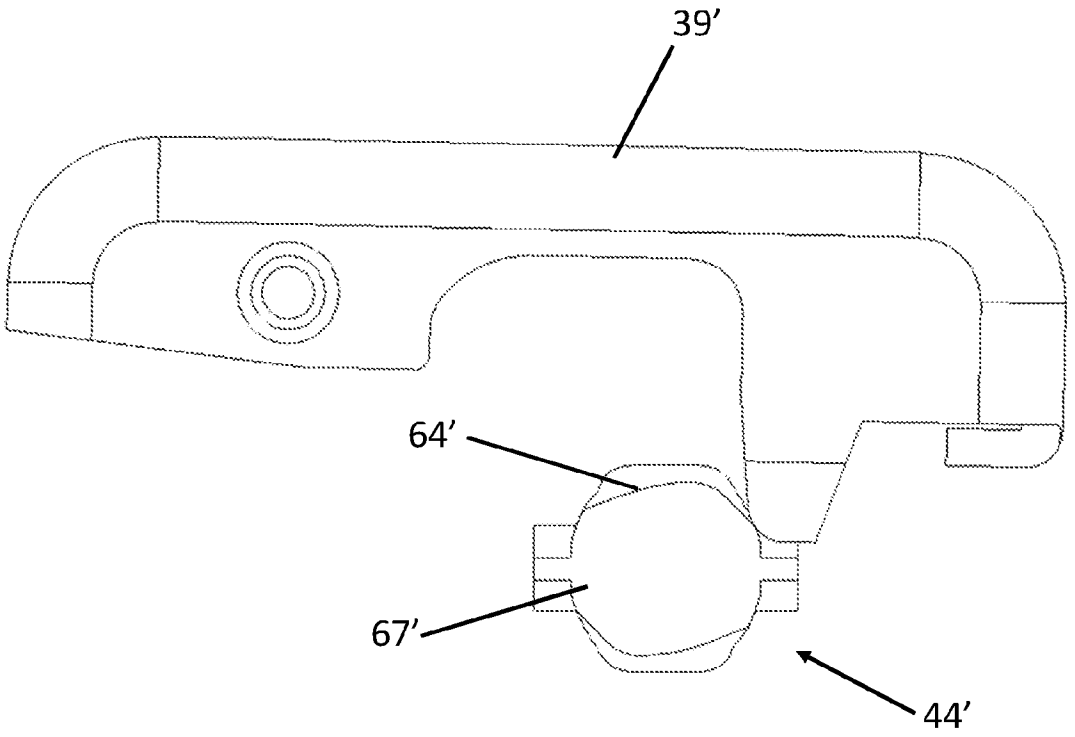
Figure 18:
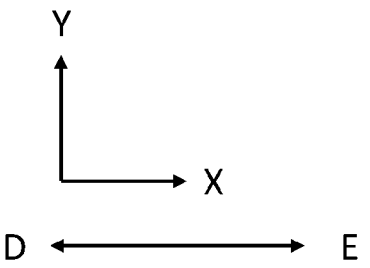

FIG. 16 shows the slider and coupling element 44' after the predetermined force has been exceeded. As can be seen, after the predetermined force has been exceeded the locking pin 39' translates in a direction parallel to the normal axis Y (and in a direction parallel to the longitudinal axis X such that the locking pin 39' engages the upper surface 86' of the grooved portion 67'. The locking pin 39' and/or the body of the slider (not depicted in FIG. 16—it has been removed for clarity) may also rotate about an axis parallel to the lateral axis (which extends out of the page of FIG. 16). With continued application of a force to move the slider in the second direction E, the locking pin 39' continues to travel along the upper surface 86' of the grooved portion 67'. However, if the force is removed, the slider may return to the position shown in FIG. 15. As the locking pin 39' continues to travel along the upper surface 86' of the grooved portion 67', the locking pin 39' continues to translate in a direction parallel to the normal axis Y. Alternatively or additionally, the body of the slider and/or locking pin 39' may rotate about an axis parallel to the lateral axis with continued travel of the locking pin 39' along the upper surface 86' of the grooved portion 67'. In FIG. 17, the locking pin 39' has moved to be in contact with the portion of the first groove portion 72' of the upper groove 64' that defines the minimum depth (not labelled in FIG. 17 for clarity). Again, as the locking pin 39' travels along the upper surface 64' of the grooved portion 67', the locking pin 39' translates in a direction parallel to the normal axis Y, and/or the locking pin 39' and/or the body of the slider rotate about an axis that is parallel to the lateral axis. In FIG. 18, the locking pin 39' has completely passed over the upper surface 64' of the grooved portion 67' of the coupling element 44'.

In addition to allowing the locking pin 39' to pass over the grooved portion 67' once the predetermined force has been exceeded, the shape of the grooved portion 67' also improves the strength of the grooved portion 67'. The reduced areas of the grooved portion 67' formed as a result of the geometry of the second groove portion 74' of the upper groove 64' is compensated for by the increased area of the grooved portion 67' formed as a result of the geometry of the first groove portion 72' of the upper groove 64', and by the second groove portion 78' of the lower groove 66'. In addition, the reduced area of the grooved portion 67' formed as a result of the geometry of the first groove portion 76' of the lower groove 66' is compensated for by the increased area of the grooved portion 67' formed as a result of the geometry of the first groove portion 72' of the upper groove 64', and by the second groove portion 78' of the lower groove 66'. This improves the strength of the neck in the lateral direction Z.

Figure 19:
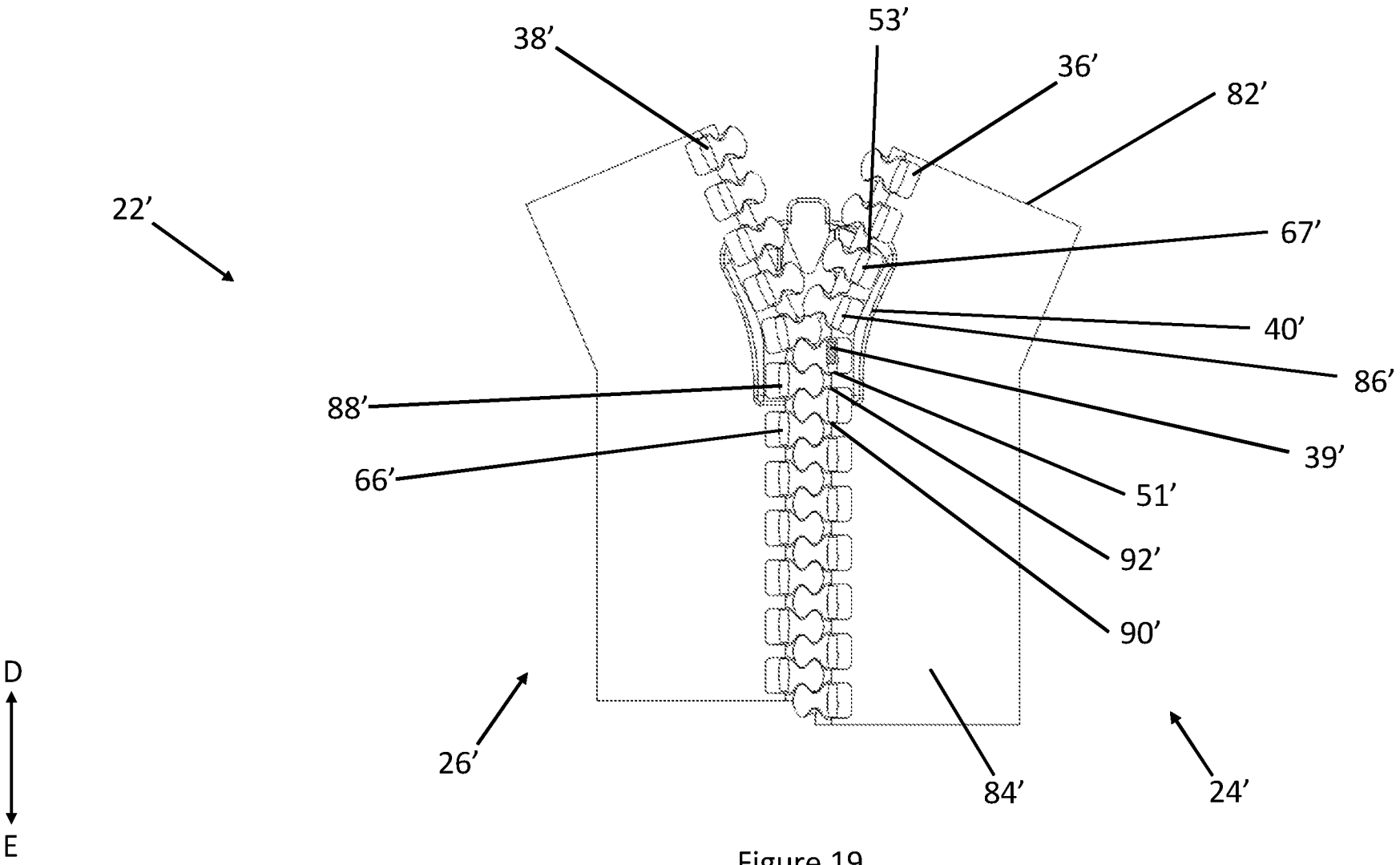
FIG. 19 shows a slide fastener that comprises a plurality of coupling elements of FIG. 12.

Referring now to FIG. 19. The coupling elements 36' of the first stringer 24' are orientated such that the second portion 53' of the groove portion 67' of each of the coupling elements 36' of the first stringer 24' face towards a top end 82' of the slide fastener 22' (the position of the top end 82' in FIG. 19 is merely representative since FIG. 19 shows only a portion of the slide fastener 22'). The coupling elements 36' of the first stringer 24' are also orientated such that the upper groove 64' of each coupling element is disposed at a front side 84' of the slide fastener 22'. Therefore, when the slider 40' is urged in the second direction E and with the locking pin 39' (only a portion of which is visible in FIG. 19 due to the position of the plane that defines the cross-sectional view) of the slider 40' in the first position, the locking pin 39' engages the upper surface 86' of the grooved portion 67' at the second end 92' of the second portion 53' of the grooved portion 67' of a coupling element of the coupling elements 36', which corresponds to the maximum depth d2'. Similarly, when the slider is urged in the first direction D and with the locking pin 39' of the slider 40' in the first position, the locking pin 39' engages the upper surface 86' of the grooved portion 67' at the first end 90' of the first portion 51' of the grooved portion 67' of a coupling element of the coupling elements 36', which corresponds to the minimum depth d1'.

Where the coupling elements 36' of the first stringer 24' are positioned in the alternative orientation, not depicted, the coupling elements 36' are orientated such that the first portion 51' of the grooved portion 67' of each of the coupling elements 36' face towards the top end 82' of the slide fastener. In the alternative orientation, the coupling elements 36' are also orientated such that the lower groove 66' of each coupling element is disposed at the front side 84' of the slide fastener 22'. Therefore, in the alternative orientation, when the slider 40' is urged in the second direction E and with the locking pin 39' of the slider 40' in the first position, the locking pin 39' engages lower surface 88' of the grooved portion 67' at the first end 90' of the first portion 51' of the grooved portion 67' of a coupling element of the coupling elements 36', which corresponds with the maximum depth d4'. Similarly, when the slider is urged in the first direction D and with the locking pin 39' of the slider 40' in the first position, the locking pin 39' engages the lower surface 88' of the grooved portion 67' at the second end 92' of the second portion 53' of the grooved portion 67' of a coupling element of the coupling elements 36', which corresponds to the minimum depth d3'.

The coupling elements 38' of the second stringer 26' are orientated such that the second portion 53' of the grooved portion 67' of each of the coupling elements 38' face away from the top end 82' of the slide fastener 22'. The coupling elements 38' of the second stringer 26' are also orientated such that the lower groove 66' of each coupling element is disposed at the front side 84' of the slide fastener 22'. Therefore, with a locking pin of a second slider (not shown), where provided, in the first position and when the second slider is urged in the first direction D, the locking pin 39' engages the lower surface 88' of the grooved portion 67' at the second end 92' of the second portion 53' of the grooved portion 67' of a coupling element of the coupling elements 38', which corresponds with the maximum depth d4'. Similarly, with the locking pin of the second slider in the first position and when the second slider is urged in the second direction E, the locking pin engages the lower surface 88' of the grooved portion 67' at the first end 90' of the first portion 51' of the grooved portion 67' of a coupling element of the coupling elements 38', which corresponds with the minimum depth d3'.

Where the coupling elements 38' of the second stringer 26' are positioned in the alternative orientation, not depicted, the coupling elements 38' are orientated such that the first portion 51' of the grooved portion 67' of each of the coupling elements 38' face away the top end 82' of the slide fastener. In the alternative orientation, the coupling elements 38' are also orientated such that the upper groove 64' of each coupling element is disposed at the front side 84' of the slide fastener 22'. Therefore, in the alternative orientation, with the locking pin 39' of the slider 40' in the first position and when the second slider is urged in the second direction E, the locking pin 39' engages the upper surface 86' of the grooved portion 67' at the second end 92' of the second portion 53' of the grooved portion 67' a coupling element of the coupling elements 38', which corresponds to the minimum depth d1'. Similarly, with the locking pin of the second slider in the first position and when the slider is urged in the first direction D, the locking pin engages the upper surface 86' of the grooved portion 67' at the first end 90' of the first portion 53' of the grooved portion 67' of a coupling element of the coupling elements 38', which corresponds to the maximum depth d2'.

From the above, it can be said that the coupling elements 36', 38' of each of the stringers are orientated such that the locking pin of a slider being moved, or urged, in a direction to decouple the coupling elements engages the end of the grooved portion 67' that defines the maximum depth. In addition, when the slider being moved, or urged, in a direction to couple the coupling elements, the locking pin engages the end of the grooved portion 67' that defines the minimum depth.

In some embodiments, with the locking pin 39' of the slider 40' in the first position, the locking pin 39' may engage a coupling element 38' of the second stringer 26'. In some embodiments, with the locking pin of the second slider in the first position, the locking pin may engage a coupling element 36' of the first stringer 24'.

Since the coupling elements 36', 38' can be affixed to their respective fastener tape 28', 30' in one of two possible orientations, the above description applies mutatis mutandis to where the coupling elements 36' of the first stringer 24' and/or the coupling elements 38' of the second stringer 36' are disposed in the alternative orientation.

Figure 20:
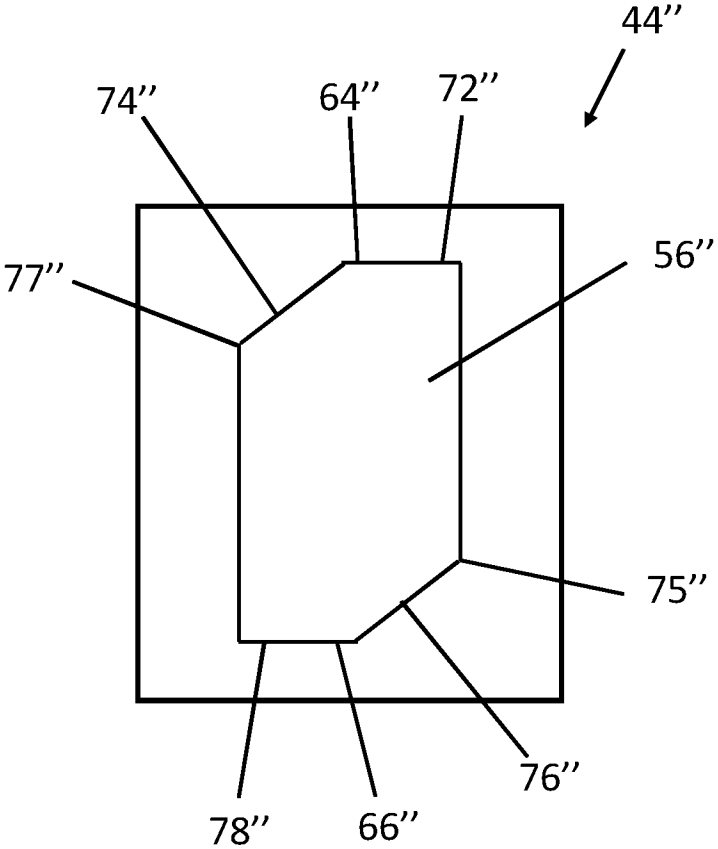
FIG. 20 shows an alternative embodiment of a coupling element in accordance with the present invention.

FIG. 20 shows an alternative embodiment of the coupling element 44". FIG. 20 shows a cross-sectional view of the coupling element 44" taken through the neck 56" in a plane perpendicular to the lateral axis Z (which extends out of the page of FIG. 20). In this embodiment, the depth of the first groove portion 72" of the upper groove 64" is constant. The second groove portion 74" of the upper groove 64" is tapered. Therefore, the depth of the second groove portion 74" of the upper groove 64" gradually decreases from the second end 77" of the neck 56" to the first groove portion 72" of the upper groove 64". In some embodiments, the second groove portion 74" of the upper groove 64" may be radiused. Where the second groove portion 74" of the upper groove 64" is radiused, the second groove 74" portion of the upper groove 64" may be convex or concave. The depth of the second groove portion 78" of the lower groove 66" is constant. The first groove portion 76" of the lower groove 66" is tapered. Therefore, the depth of the first groove portion 76" of the lower groove 66" gradually decreases from the first end 75" of the neck 56" to the second groove portion 74" of the lower groove 66". In some embodiments, the first groove portion 76" of the lower groove 64" may be radiused. Where the first groove portion 76" of the lower groove 66" is radiused, the first groove portion 76" of the lower groove 66" may be convex or concave. The features and geometry of the upper groove and the lower groove of this embodiment apply mutatis mutandis to embodiments in which the upper groove and the lower groove are provided to the main body of the coupling element.

Figure 21:
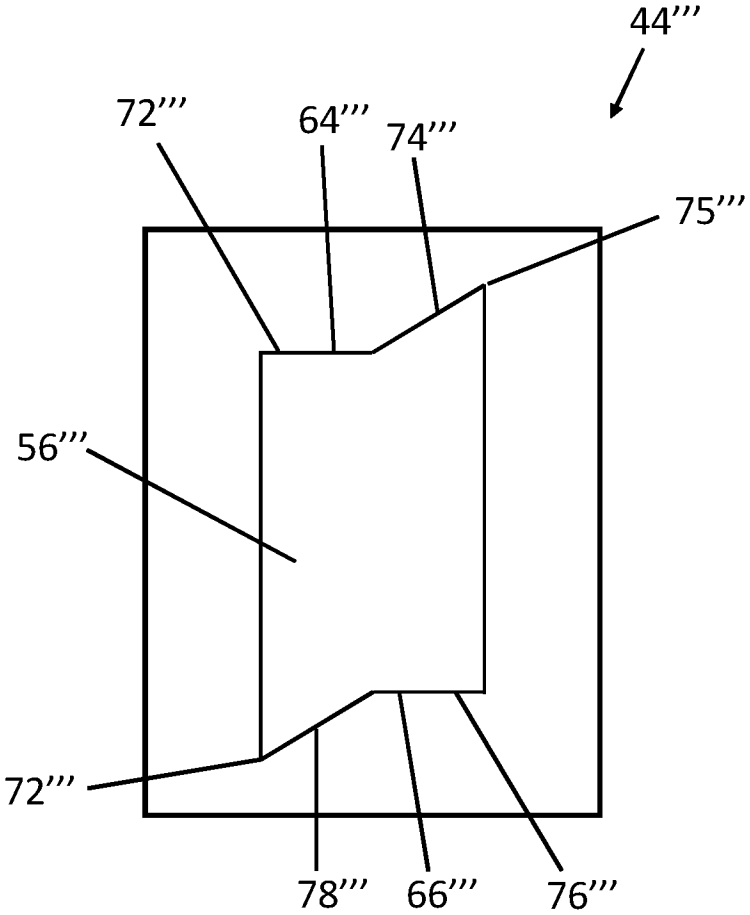
FIG. 21 shows a further alternative embodiment of a coupling element in accordance with the present invention.

FIG. 21 shows a further alternative embodiment of the coupling element 44''' taken through the neck 56''' in a plane perpendicular to the lateral axis Z (which extends out of the page of FIG. 21). In this embodiment, the depth of the second groove portion 72''' of the upper groove 64''' is constant. The first groove portion 72''' of the upper groove 64''' is tapered. Therefore, the depth of the first groove portion 72''' of the upper groove 64''' gradually increases from the first end 75''' of the neck 56''' to the second groove portion 74''' of the upper groove 64'''. In some embodiments, the first groove portion 72''' of the upper groove 64''' may be radiused. Where the first groove portion 72''' of the upper groove 64''' is radiused, the first groove 72" portion of the upper groove 64''' may be convex or concave. The depth of the first groove portion 76''' of the lower groove 66''' is constant. The second groove portion 78''' of the lower groove 66''' is tapered. Therefore, the depth of the second groove portion 78''' of the lower groove 66''' gradually increases from the second end 77''' of the neck 56''' to the first groove portion 76''' of the lower groove 66'''. In some embodiments, the second groove portion 78''' of the lower groove 66''' may be radiused. Where the second groove portion 78''' of the lower groove 66''' is radiused, the second groove portion 78''' of the lower groove 66''' may be convex or concave. The features and geometry of the upper groove and the lower groove of this embodiment apply mutatis mutandis to embodiments in which the upper groove and the lower groove are provided to the main body of the coupling element.

While specific embodiments of the invention have been described above, it will be appreciated that the invention may be practiced otherwise than as described. The descriptions above are intended to be illustrative, not limiting. Thus, it will be apparent to one skilled in the art that modifications may be made to the invention as described without departing from the scope of the claims set out below.

The invention claimed is:

1. A coupling element for a slide fastener comprising:

a main body having spaced shoulder portions, a first upper surface and a first lower surface, the main body being configured to be mountable, in use, to a fastener tape of the slide fastener; and a head portion extending parallel to a lateral axis, away from the shoulder portions via a neck located between the shoulder portions, the neck comprising a second upper surface and a second lower surface;

wherein the coupling element defines a proximal portion, the proximal portion comprising the main body and the neck, the proximal portion comprising a third upper surface and a third lower surface;

wherein the proximal portion defines a first portion and a second portion, the second portion being disposed along a longitudinal axis, perpendicular to the lateral axis, adjacent to the first portion;

wherein the proximal portion comprises an upper groove that extends parallel to the longitudinal axis along the third upper surface of the proximal portion, the upper groove having a first groove portion in a region of the first portion of the proximal portion and a second groove portion in a region of the second portion of the proximal portion;

wherein the first groove portion of the upper groove defines a minimum depth, the minimum depth of the first groove portion of the upper groove being the smallest depth of the upper groove;

wherein the proximal portion comprises a lower groove that extends parallel to the longitudinal axis along the third lower surface of the proximal portion, the lower groove having a third groove portion in the region of the first portion of the proximal portion and a fourth groove portion in the region of the second portion of the proximal portion; and wherein the fourth groove portion of the lower groove defines a minimum depth, the minimum depth of the fourth groove portion of the lower groove being the smallest depth of the lower groove.

2. The coupling element of claim 1, wherein the second groove portion of the upper groove defines a maximum depth, the maximum depth of the second groove portion of the upper groove being the greatest depth of the upper groove.

3. The coupling element of claim 2, wherein the maximum depth of the second groove portion of the upper groove is at least 15% greater than the minimum depth of the first groove portion of the upper groove; and/or wherein the maximum depth of the second groove portion of the upper groove is up to seven times greater than the minimum depth of the first groove portion of the upper groove.

4. The coupling element of claim 1, wherein the third groove portion of the lower groove defines a maximum depth, the maximum depth of the third groove portion of the lower groove being the greatest depth of the lower groove.

5. The coupling element of claim 4, wherein the maximum depth of the third groove portion of the lower groove is at least 15% greater than the minimum depth of the fourth groove portion of the lower groove; and/or wherein the maximum depth of the third groove portion of the lower groove is up to seven times greater than the minimum depth of the fourth groove portion of the lower groove.

6. The coupling element of claim 1, wherein the proximal portion is rotationally symmetric when viewed in a cross-sectional plane that is perpendicular to the lateral axis and including the upper groove and the lower groove.

7. The coupling element of claim 1, wherein the main body defines a thickness that extends from the first upper surface to the first lower surface in a direction perpendicular to the lateral axis and to the longitudinal axis, and wherein:

i) a maximum depth of the second groove portion of the upper groove is at least 5% of the thickness of the main body; and/or ii) a maximum depth of the second groove portion of the upper groove is up to 30% of the thickness of the main body; and/or iii) a maximum depth of the third groove portion of the lower groove is at least 5% of the thickness of the main body; and/or iv) a maximum depth of the third groove portion of the lower groove is up to 30% of the thickness of the main body.

8. The coupling element of claim 1, wherein the first portion of the proximal portion comprises 50% of a length of the proximal portion in a direction parallel to the longitudinal axis, and the second portion of the proximal portion comprises 50% of the length of the proximal portion in the direction parallel to the longitudinal axis.

9. The coupling element of claim 1, wherein the first portion of the proximal portion defines a first end in a direction parallel to the longitudinal axis and the second portion of the proximal portion defines a second end in a direction parallel to the longitudinal axis, and wherein:

i) the minimum depth of the first groove portion of the upper groove is offset from the first end of the proximal portion in a direction parallel to the longitudinal axis; and/or wherein ii) the minimum depth of the fourth groove portion of the lower groove is offset from the second end of the proximal portion in a direction parallel to the longitudinal axis.

10. The coupling element of claim 1, wherein the upper groove and the lower groove are formed in the neck; or wherein the upper groove and the lower groove are formed in the main body.

11. The coupling element of claim 10, wherein one of the main body and the neck that comprises the upper groove and the lower groove is generally parallelogram-shaped in a cross-section taken perpendicular to the lateral axis and in a plane including the upper groove and the lower groove.

12. A stringer for a slide fastener comprising:

a fastener tape that defines a longitudinal edge; and a plurality of coupling elements according to claim 1, the plurality of coupling elements being mounted along the longitudinal edge of the fastener tape.

13. A slide fastener comprising:

a first stringer according to claim 12 and a second stringer according to claim 12, the coupling elements of the first stringer being couplable to the coupling elements of the second stringer along a fastener axis; and a first slider that comprises a locking pin, the locking pin being movable between a first position in which the locking pin is engageable with one or more of the coupling elements of the first stringer and/or of the second stringer, and a second position in which the locking pin is disengaged from the coupling elements of the first stringer and of the second stringer;

wherein the first slider is movably mounted on the first stringer and the second stringer in use, such that the first slider is movable relative to the first stringer and the second stringer along:

a first direction, towards an upper end of the slide fastener, in order to interdigitate the coupling elements of the first stringer with the coupling elements of the second stringer; and a second direction, away from the upper end of the slide fastener, in order to decouple the coupling elements of the first stringer from the coupling elements of the second stringer.

14. The slide fastener of claim 13, wherein the plurality of coupling elements of the first stringer are orientated such that the minimum depth of the first groove portion of the upper groove of each of the coupling elements face the upper end of the slide fastener.

15. The slide fastener of claim 14, wherein the coupling elements and the locking pin are configured such that, with the locking pin in the first position, the locking pin passes over the one or more of the coupling elements with which it is engaged once a load to move the first slider along the second direction exceeds a predetermined value.

16. The slide fastener of claim 13, wherein the plurality of coupling elements of the second stringer are orientated such that the minimum depth of the first groove portion of the upper groove of each of the coupling elements face away from the upper end of the slide fastener.

* * * * *